US008347906B1

(12) United States Patent
Ismert et al.

(10) Patent No.: US 8,347,906 B1
(45) Date of Patent: Jan. 8, 2013

(54) FLOOR DRAIN INSTALLATION SYSTEM

(75) Inventors: Joseph P. Ismert, Kansas City, MO (US); Frank D. Julian, Kansas City, MO (US)

(73) Assignee: Sioux Chief Mfg. Co., Inc., Peculiar, MO (US)

( * ) Notice: Subject to any disclaimer, the term of this patent is extended or adjusted under 35 U.S.C. 154(b) by 141 days.

(21) Appl. No.: 12/785,772

(22) Filed: May 24, 2010

Related U.S. Application Data

(63) Continuation of application No. 11/464,101, filed on Aug. 11, 2006, now Pat. No. 7,735,512.

(60) Provisional application No. 60/707,660, filed on Aug. 12, 2005.

(51) Int. Cl.
*B08B 17/04* (2006.01)

(52) U.S. Cl. ..... 137/15.01; 137/362; 4/286; 4/288; 4/293

(58) Field of Classification Search ..... 137/362, 137/15.01; 4/286, 288, 293
See application file for complete search history.

(56) References Cited

U.S. PATENT DOCUMENTS

| | | | | |
|---|---|---|---|---|
| 1,007,463 | A | | 10/1911 | Madden |
| 1,648,701 | A | | 11/1927 | Smallbrook |
| 1,766,621 | A | | 6/1930 | Fleming |
| 1,792,345 | A | | 2/1931 | Williams |
| 2,471,301 | A | | 5/1949 | Boosey |
| 2,501,971 | A | | 3/1950 | Schenck |
| 2,684,518 | A | | 7/1954 | Whitlock |
| 3,285,289 | A | | 11/1966 | Titus |
| 3,362,425 | A | | 1/1968 | Morris et al. |
| 4,067,072 | A | | 1/1978 | Izzi |
| 4,146,939 | A | | 4/1979 | Izzi |
| 4,620,330 | A | | 11/1986 | Izzi, Sr. |
| 4,694,513 | A | | 9/1987 | Kiziah |
| 4,823,411 | A | | 4/1989 | Nettel |
| 4,879,771 | A | | 11/1989 | Piskula |
| 4,883,590 | A | | 11/1989 | Papp |
| 5,063,718 | A | * | 11/1991 | Nonis ..... 52/235 |
| 5,623,971 | A | | 4/1997 | Foernzler |
| 5,996,134 | A | | 12/1999 | Senninger |
| 6,085,362 | A | | 7/2000 | Huber |
| 6,088,972 | A | | 7/2000 | Johanneck |
| 6,101,774 | A | | 8/2000 | Heil |
| 6,557,588 | B2 | | 5/2003 | Wright |
| 6,595,243 | B2 | | 7/2003 | Tarr |
| 6,687,925 | B2 | | 2/2004 | Minnick |
| 2003/0150500 | A1 | | 8/2003 | Molina |

OTHER PUBLICATIONS

Request for Reexamination filed Jan. 10, 2011 for Patent No. 7,735,512, from which this application claims priority.

Page 138 of Josam catalog, publication date unknown but products shown believed to be on sale prior to date of invention of the invention disclosed in this application.

(Continued)

*Primary Examiner* — Kevin Lee
*Assistant Examiner* — Macade Brown
(74) *Attorney, Agent, or Firm* — Erickson, Kernell, Derusseau & Kleypas, LLC

(57) ABSTRACT

A floor drain installation system includes an adaptor attached to a drain pipe projecting from the ground, a coring sleeve having a bowl-shaped upper end attached to or integral with the adaptor, and a coring plug received within the bowl of the receiver to close off the drain pipe during pouring of a concrete floor and to create a space for subsequent reception of a drain head and grate.

29 Claims, 17 Drawing Sheets

OTHER PUBLICATIONS

Declaration of Steve Guyton, with reference to paragraph 6, discussing public use of Styrofoam discs in place of drain strainers during pouring concrete around drains.

File History for Re-Examination Control No. 90/011,425.
File History for Re-Examination Control No. 90/011,425 after Dec. 1, 2011.

* cited by examiner

Fig. 1
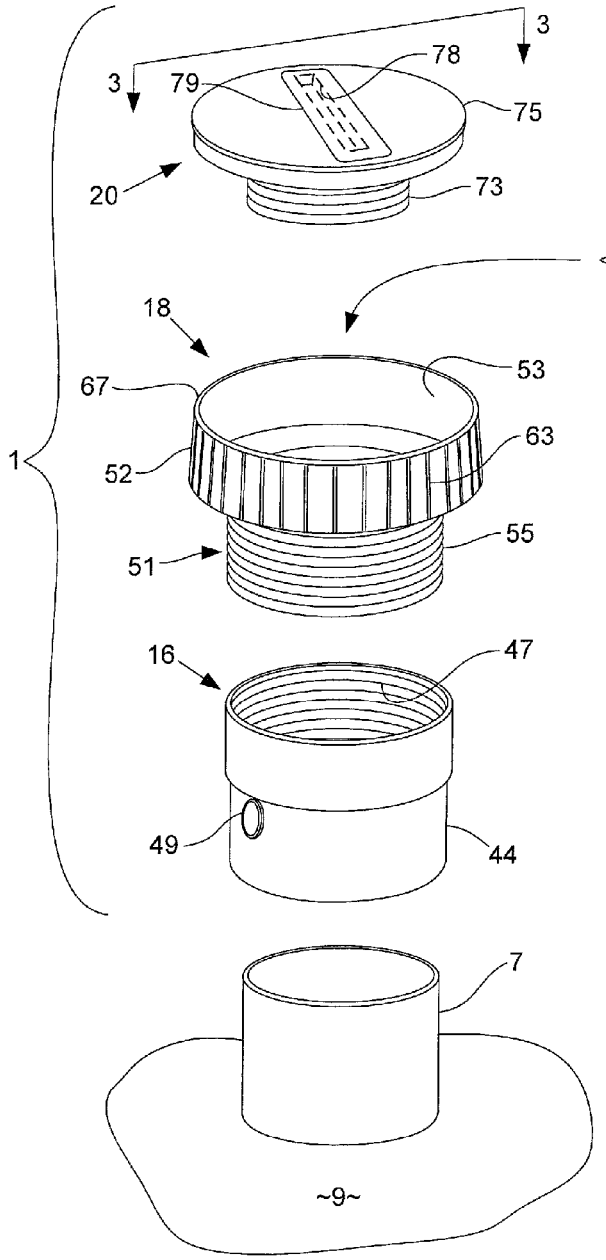
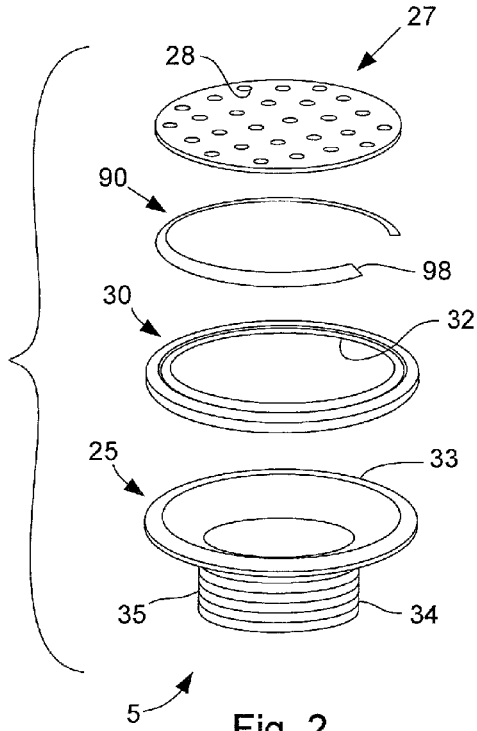
Fig. 2

Fig. 15
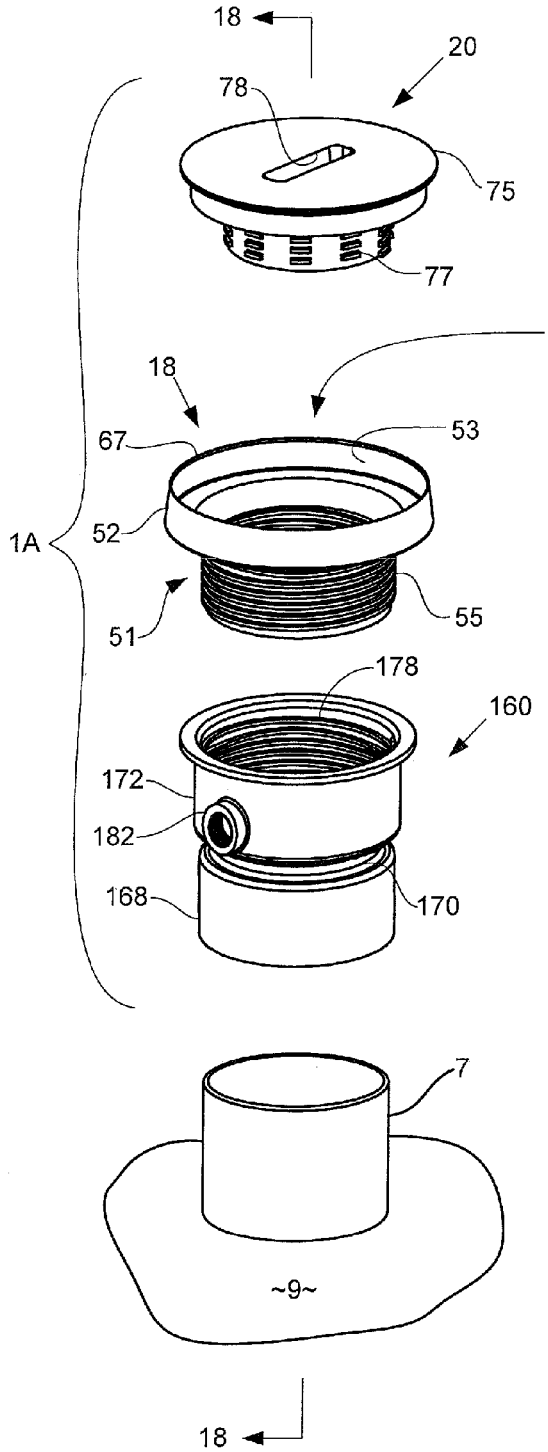
Fig. 16
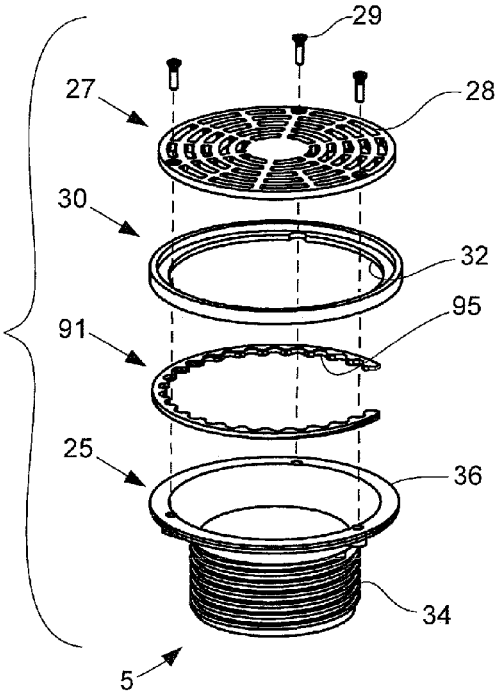
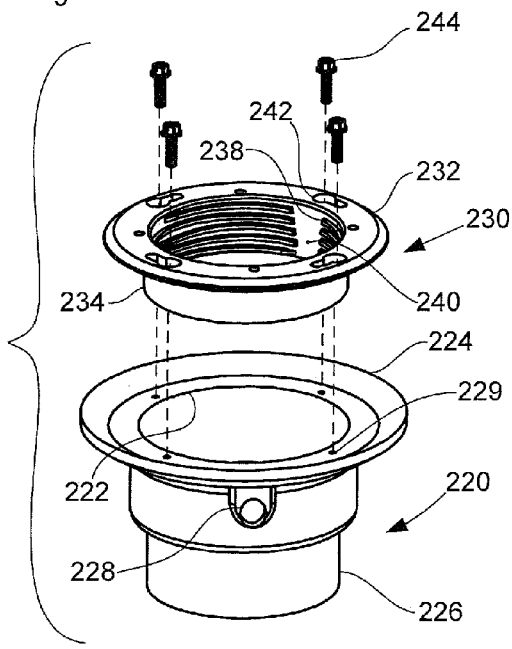
Fig. 17

FLOOR DRAIN INSTALLATION SYSTEM

CROSS REFERENCE TO RELATED APPLICATIONS

This application is a Continuation of application Ser. No. 11/464,101 filed Aug. 11, 2006 which claimed the benefit of co-pending Provisional Application No. 60/707,660 Filed Aug. 12, 2005.

BACKGROUND OF THE INVENTION

This invention relates to drains and other utility inlet or outlet type fixtures installed in concrete slabs or floors, and, more particularly, to a system for installing such fixtures using a concrete coring adaptor around which the slab is poured. As used herein, the term fixture is generally intended to include inlet or outlet type utility fixtures such as plumbing drains or drain fixtures, cleanouts, or cleanout fixtures as well as inlets or outlets for electrical conduit or other utility applications.

Drains or drain fixtures are installed in concrete slabs, such as concrete floors in warehouses, garages, basements, parking lots, commercial buildings and residential buildings, to accept water or other liquids from the top surface of the floor and provide a means for such liquids to flow into an underlying drain pipe. The drain is typically funnel shaped, with a tapered upper portion or drain head and a lower stem adapted for connecting the drain to an adaptor or extension member for a drain pipe projecting from the ground or substrate underlying the slab. The drain head includes a grate or strainer at an upper end thereof to prevent large pieces of debris from entering and clogging the drain pipe.

A typical prior art installation assembly includes a female threaded adaptor or connector that is attached to a vertically extending drain pipe. A drain, drain assembly or cleanout with a threaded lower section is threaded into the adaptor. As used herein, the term drain is intended to be interpreted broad enough to include cleanouts or cleanout cover assemblies as well as drains or drain assemblies. The height of the drain or drain assembly may be minimally adjusted up or down by threading the drain further into or out of the adaptor.

Typically, drain adaptors and associated drains are installed upon the drain pipe prior to pouring the surrounding concrete slab that typically provides the primary floor support surface. Ideally, the drain is installed by the plumber at the proper height to allow for proper drainage and so that the grate will be flush with the finished floor surface. Plumbers will often cover the drains with duct tape or plastic to prevent the heads of the drains or drain heads from being damaged or infiltrated by concrete during pouring of the floor. Considerable time is then required to clean the drains, to remove tape or the like after the floor has been poured and set. In addition, the drains are subject to damage from heavy loads rolled across the floor during construction of additional building structures.

Additional problems can arise when a layer of tile or other flooring material is installed over the concrete slab. In such instances, the plumber typically installs the drains so that the top surfaces will extend above the level of the slab a distance equal to the thickness of the flooring. Unfortunately, it is not uncommon for concrete crews to mistakenly pour the slab to the top of the drains instead of the specified lower level, thereby creating the need for further upward adjustment of the drains. Such adjustment is often not provided for by the drain and adaptor assembly. Alternatively, concrete crews sometimes take it upon themselves to lower the drains to the level of the concrete pour.

In either case, once the concrete is poured around the drains and has set, it is usually impossible to raise or lower the drains (accomplished by turning them relative to the associated adaptor) without chipping away the concrete surrounding the drain to provide clearance for lugs usually formed on the bottom of the drain head and to break the adhesion between the concrete and the drain head surface. Similarly, if the building owner later decides to add a layer of flooring over the slab or to substitute existing flooring with a thicker layer, it is usually impossible to raise the drains to the higher level without first chipping or breaking away the concrete from around the drain head.

It is clear that there is an existing need for a system for installing floor drains that provides for easy installation, reduces damage to drain heads during and after pouring the surrounding slab, and provides a ready means for later height adjustment.

BRIEF DESCRIPTION OF THE INVENTION

A system for installing inlet or outlet type utility fixtures, such as drains or cleanouts includes an adaptor attached in communication with a conduit, a coring sleeve or receiver attached or formed in communication with the adaptor, and a removable coring plug or cap that fits within an upper portion of the coring sleeve to seal the coring sleeve closed during pouring of a surrounding concrete slab. In one embodiment the coring plug is formed of resilient material capable of withstanding pressure and impact and which is sufficiently inexpensive to manufacture to justify disposal after use. The plug includes a tool-receiving slot or other structure to facilitate removal of the plug after the slab has set. The coring plug cooperates with the coring sleeve to form a cavity or void in the concrete sized to receive the head of the fixture such that it may be connected to the coring sleeve and adjusted such that its upper surface is generally flush with the finished floor. In one embodiment, a bowl formed on an upper end of the coring sleeve defines the void and the plug cooperates with or covers the bowl to keep concrete out of the bowl. In another embodiment the plug or cap forms a substantial portion of the void including the sides thereof. In either case, after the concrete sets, the plug is removed and a fixture such as a drain is threaded into the receiver through the void. The drain head is then raised or lowered to the appropriate height, typically flush with the slab or overlying floor structures, by rotating the drain relative to the receiver.

The head of the drain typically includes an outwardly projecting flange upon which is mounted or formed a collar which in turn supports a grate or strainer. In the case of slanting floor surfaces or drain pipe assemblies that deviate from near vertical, it may be necessary to cant or tilt the drain head grate relative to the drain in order for it to match the plane of the floor surface. The present invention provides an optional shim that may be installed between an upper surface of the drain head flange and the collar to raise one end of the collar and the grate. The shim may take the form of an annular or semi-annular ring that decreases in thickness from one edge to the opposing edge so as to present the shape of a wedge in cross section. In the semi-annular shim, a gap is formed in the thin end of the shim.

Other advantages of the invention will become apparent from the following description taken in connection with the accompanying drawings, wherein is set forth by way of illustration and example embodiments of the present invention.

BRIEF DESCRIPTION OF THE DRAWINGS

FIG. 1 is an exploded, perspective view of a floor drain installation system connected to a drain line prior to pouring a concrete slab.

FIG. 2 is an exploded, perspective view of a drain assembly for connecting to the floor drain installation system subsequent to pouring the slab and removal of the coring cap or plug therefrom.

FIG. 15 is an exploded, perspective view of a floor drain installation system connected to a drain line prior to pouring a concrete slab.

FIG. 16 is an exploded, perspective view of a drain assembly for connecting to the floor drain installation system subsequent to pouring the slab and removal of the coring plug therefrom.

FIG. 17 is an exploded, perspective view of a clamping ring and flashing adaptor assembly.

DETAILED DESCRIPTION

As required, detailed embodiments of the present invention are disclosed herein; however, it is to be understood that the disclosed embodiments are merely exemplary of the invention, which may be embodied in various alternative forms. Therefore, specific structural and functional details disclosed herein are not to be interpreted as limiting, but merely as a basis for the claims and as representative bases for teaching one skilled in the art to variously employ the present invention in virtually any appropriately detailed structure. As used herein, the term concrete is intended to include any material which can be poured and then sets or hardens to form a slab or the like, including a mixture of aggregate and Portland cement and aggregate and asphalt.

Figure 4:
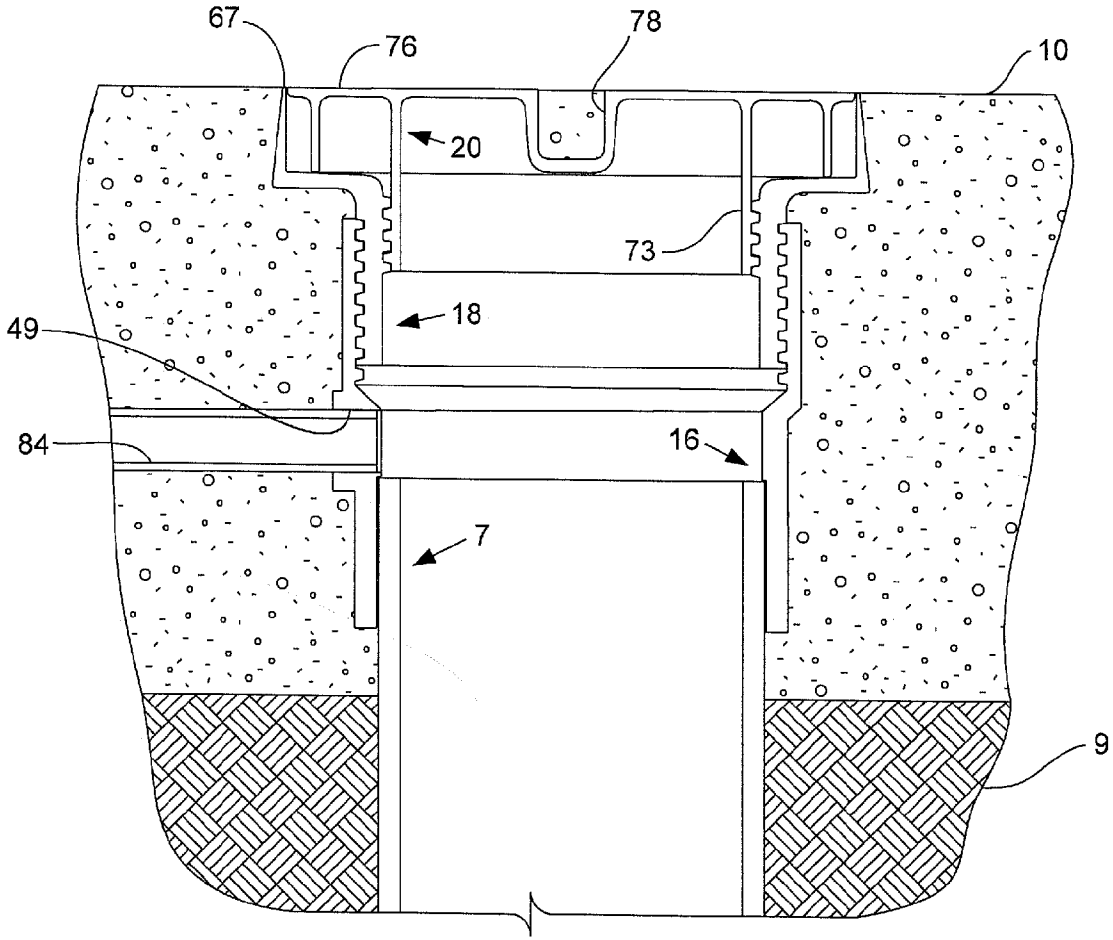
FIG. 4 is a cross sectional view of the floor drain installation system of FIG. 1 shown after the slab has been poured.

Referring now to the drawings, and in particular to FIG. 1, there are shown components of an embodiment of a floor drain installation system or rough-in assembly 1 which might more generally be described as a system for connecting utility access fixtures to a conduit in a poured slab. Besides applications in the field of plumbing for drains and cleanouts, it is foreseen that the same structure could be utilized for securing fixtures associated with electrical or ventilation utilities in a concrete slab. The rough-in assembly 1 is particularly well adapted for connecting a drain or drain assembly 5 to a drain pipe (see FIG. 2) projecting from a subsurface 9, such as ground prepared to receive a poured concrete slab 10 (see e.g. FIGS. 4-6). At its lower end, the drain pipe 7 is typically contiguously connected to a sanitary plumbing system (not shown). The assembly 1 includes an adaptor 16 engaged with or connected to the open, upper end of the drain pipe 7, a receiver or coring sleeve 18 connected to the upper portion of the adaptor 16, and a coring plug or cap 20 removably connected to the upper portion of the coring sleeve 18 to close off the internal passage or bore that runs through the coring sleeve 18, adaptor 16 and drain pipe 7. When these components are attached together to form a floor drain installation system 1 or rough-in drain assembly 1 and connected to drain pipe 7, the assembly 1 allows a concrete pad or slab 10 to be poured level with the upper end of the plug 20 as shown in FIG. 4, without concrete entering the drain pipe 7 or clogging the drain 5. It should be appreciated that the system disclosed herein will work with any commonly used poured and set flooring such as asphalt or concrete, and/or flooring using set pieces such as brick, flagstone or concrete pavers.

FIG. 2 is an illustration of a conventional drain 5 which may be secured to the rough-in assembly 1 once the slab 10 is poured and allowed to harden and the coring plug 20 is removed. The drain 5 shown includes a drain head 25 including a grate or strainer 27 provided with slots or holes 28 for allowing fluid to enter the drain 5, and a drain head collar 30 with an inwardly directed shoulder 32 for use in attaching the strainer 27 (or alternatively a clean out cover, not shown) to a drain head flange 33. The drain 5 further comprises a cylindrical stem or neck 34 with external threads 35 extending from the bottom of the drain head flange 33. The drain head flange 33 curves or flares upward and radially outward from the threaded neck 34 terminating in an annular shoulder or lip adapted to support the collar 30 and strainer 27, see FIGS. 2, 7 and 9. The strainer 27 and collar 30 are secured on top of the flange 33 by screws 37 that thread into tapped holes 38 in the flange 33, see FIGS. 7 and 9. The underside of the flange 33 may be provided with a lug 39 to accommodate the length of the screw 37. The strainer 27 may be tilted or elevated by insertion of an optional shim 90 between the strainer 27 and drain head collar 30 as shown in FIG. 2 or between the drain head flange 33 and the collar 30 as seen in FIG. 16 (which shows an alternative embodiment 91 of the shim).

Returning to FIGS. 1 and 3, the rough-in assembly 1 is connected at its lower end to a drain pipe 7 by the adaptor 16. The adaptor 16 is generally cylindrical or tubular with an internal bore 42 therethrough. A lower portion of the adaptor 16 generally comprises a smooth-walled hub 44 sized for securement over and cementing or gluing to the drain pipe 7. An internal shoulder 45 formed around the bore 42 defines an upper end of the glue hub 44. An internal thread 47 is formed in the upper end of the adaptor 16 for use in connecting the adaptor 16 to the coring sleeve 18 as discussed in more detail hereafter.

The adaptor 16 may also include a trap primer port 49 between the glue hub 44 and the internal thread 47. (The trap primer port 49 is omitted from some of the drawings of the adaptor 16 to aid in clarity of illustration.) The adaptor 16 may be constructed of plastic such as the materials disclosed above but is preferably constructed of the same type of plastic that is used to form the drain pipe 7 so that solvent or cement used to join the adaptor 16 to the drain pipe 7 will be chemically compatible with each component.

Figure 3:
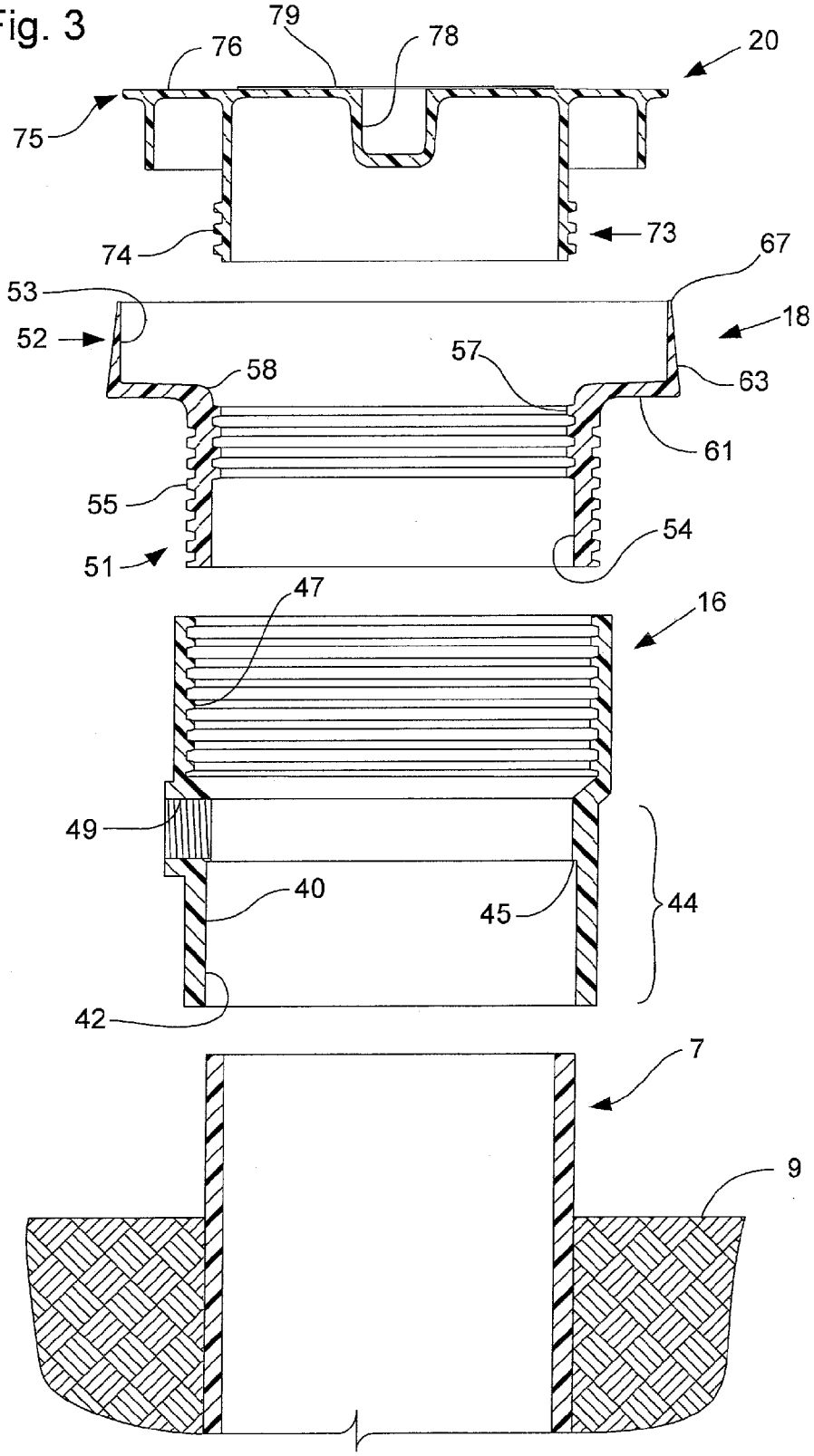
FIG. 3 is an enlarged and exploded, cross sectional view of the floor drain installation system taken along line 3-3 of FIG. 1.

With continued reference to FIGS. 1 and 3, the coring sleeve 18 shown includes a cylindrical base, neck or stem 51 with a bowl 52 projecting radially outward from an upper end of the neck 51 and forming a bowl cavity 53. A drain hole or bore 54 extends through the neck 51 and opens into the bowl 52 and bowl cavity 53. An external thread 55 is formed on the outer surface of the coring sleeve neck 51 and extends upward from a lower end thereof. The neck 51 and external thread 55 are sized for threaded receipt or engagement within the upper, internally threaded end of the adaptor 16. The threaded connection between the adaptor 16 and coring sleeve 18 permits fine adjustment of the overall length of the assembly 1 and the height or level at which the upper end of the assembly 1 can be positioned. An internal thread 57 is formed in the drain hole 54 of the coring sleeve neck 51 and extends downward from an upper end or throat 58 of the neck 51. The internal thread 57 is adapted for initial securement of the coring plug 20, and then subsequently a drain 5, to the coring sleeve 18 as discussed hereafter.

The bowl 52 projects radially outward and upward from the coring sleeve base or neck 51 to form the bowl cavity 53. In the embodiment shown in FIG. 3, the bowl 52 includes an annular flange 61 projecting radially outward and generally horizontal from the throat 58 of the coring sleeve neck 51 and an annular wall 63 projecting upward from the outer margin of the annular flange 61. An outer surface 65 of the annular wall 63 is preferably drafted at a slight angle inward from the annular flange 61 upward to a rim or upper edge 67 of the annular wall 63. The outer surface 65 of the annular wall 63 may be textured such as with a pattern of ridges 69 (see FIG. 1) to create a mechanical bond between the wall 63 and the surrounding floor surface such as the concrete slab 10 shown in the illustrations. The coring sleeve 18 is typically constructed of plastic materials such as those disclosed above. It is to be understood that as used in the claims the terms receiver or adaptor may be construed to include structures corresponding to both the adaptor 16 and coring sleeve 18 discussed above as a single component or element of the claims.

The coring plug 20 is sized for securement to the coring sleeve 18 and to at least cover the drain hole 54 and preferably such that the plug 20 extends across and covers a substantial portion of the bowl 52 or bowl cavity 53. The plug 20 includes a stem or neck 73 with an external thread 74 and a cylindrical cover portion or plug head 75 which extends radially outward from the neck 73. In the embodiment shown in FIGS. 1 and 3 the plug head 75 includes a generally flat upper surface 76 that allows for unobstructed floating of the concrete slab 10 during surface finishing. The plug 20 is adapted for threaded coupling within the coring sleeve 18 with the external thread 74 of plug stem 73 engaging the internal thread 57 in the drain hole 54 of coring sleeve 18 and the plug head 75 extending within the bowl 52 of the coring sleeve 18. Referring to FIG. 4, the plug 20 is sized such that when the plug 20 is threaded into the coring sleeve 18 as far as it will go the upper surface 76 of the plug 20 extends approximately flush with the upper edge of the bowl 52. The upper surface 76 of the plug 20 is typically positioned to extend flush with the upper edge 67 of the receiver bowl 52. It is foreseen that the plug 20 could be sized such that a peripheral edge of the plug head 75 extends just over the upper edge 67 of the receiver bowl 52. The inner surface of the coring sleeve annular wall 63 is preferably smooth to facilitate rotation of the plug head 75 relative thereto upon threading of the plug stem 73 into the neck 51 of the coring sleeve 18.

Because the coring sleeve 18 is designed to be left in the concrete after it hardens, the thickness of the annular wall 63 of coring sleeve bowl 52 is sized to present a relatively small thickness which is only minimally visible after installation of a drain 5 or other fixture in the coring sleeve 18. However the annular wall 63 proximate the upper edge 67 needs sufficient thickness for structural integrity and to prevent presenting an unnecessarily sharp edge. Although not shown, the upper edge 67 is formed with a slight radius. The thickness of the annular wall 63 just below the radius is preferably approximately twenty-five thousandths of an inch. Forming the annular wall 63 to have a thickness of up to 50 thousandths of an inch or even one tenth of an inch will still result in an appearance which is believed to be acceptable.

Because the annular wall 63 is designed to be relatively thin near the upper edge 67 of the bowl 52, it is important to provide lateral support for the annular wall 63 during the steps of pouring and finishing the concrete slab 10 and allowing it to harden, to maintain the circular geometry of the annular wall 63. If the annular wall 63 becomes deformed it may make it difficult to remove the plug 20. An outer edge of the upper portion of the plug 20 extending from the upper surface 76 thereof downward at least a short distance is sized to extend in abutting relationship with an inner surface of the bowl annular wall 63 when the plug 20 is screwed all the way down into the coring sleeve 18. The outer edge of the upper portion of the plug 20 thereby provides structural support for the annular wall 63 of bowl 52. In addition, although not shown in the drawings, the outer edge of the upper portion of the plug tapers slightly inward and downward while the inner surface of the bowl annular wall 63 near upper edge 67 also tapers inward and downward such that the abutting edges of the plug 20 and annular wall 63 form a generally watertight seal when the plug head 75 is drawn down into the coring sleeve bowl 52 due to the wedging action of the inwardly sloped outer surface of the plug 20 against the correspondingly sloped inner surface of the bowl wall 63. The seal acts to resist leaking of the liquid portion of the cement mixture into the coring sleeve 18.

A tool receiver such as slot 78 is formed in the plug head 75. The slot 78 is sized for receiving a tool (not shown) typically carried by plumbers, such as the ends of channel lock pliers. The tool is then used to provide leverage to facilitate unscrewing and removal of the plug 20 for replacement with a drain 5 as discussed hereafter. In a preferred embodiment, a thin adhesive backed sticker 79 is applied to the upper surface 76 of the plug 20 to cover the slot 78. The sticker prevents concrete from filling the slot 78 during the steps of pouring and surface finishing of the slab. After the slab hardens sufficiently, the sticker 79 can be removed or punched through with the tool to provide access to the slot 78 for the tool.

The sticker 79 is sufficiently thin such that it does not appreciably add to the height of the plug 20. Although not shown, the sticker 79 may be circular and include instructions for use of the rough-in assembly, markings to locate the slot 78 and spaces for users to mark on the sticker. If a sticker 79 is not used, the slot 78 typically becomes filled with concrete during the steps of pouring and surface finishing of the slab 10 (see FIG. 4). The size of the slot 78 is intended to facilitate the ready removal of hardened concrete therefrom by using a screwdriver, knife, blade or other suitable tool.

Figure 5:
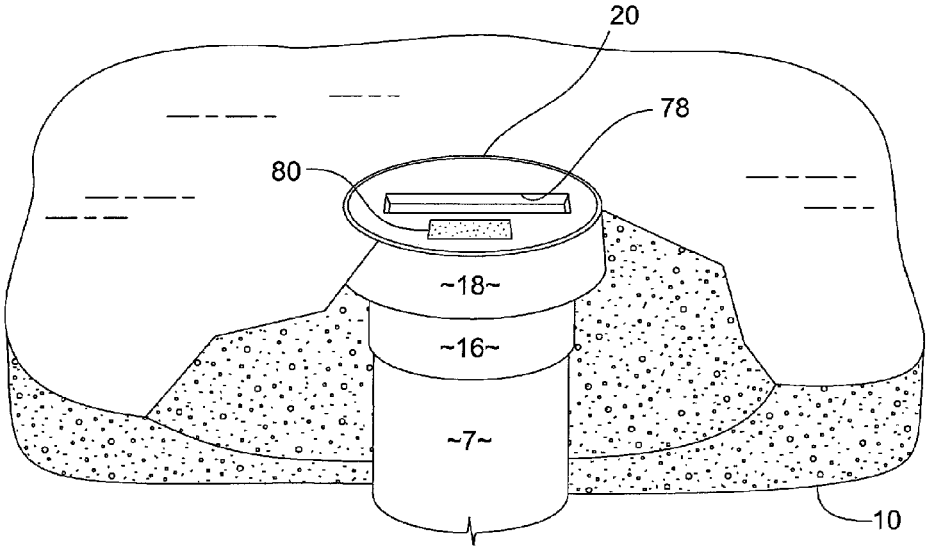
FIG. 5 is a perspective view of the floor drain installation system as installed with portions of the surrounding concrete floor slab broken away to reveal system components.

The plug 20 is designed to be left in place after the concrete slab hardens and while the surrounding structure is constructed to prevent damage to the more expensive drain 5 or cleanout during construction. To this end, the plug 20 is preferably formed of resilient material such as plastic that is capable of withstanding impact and pressure from construction materials or equipment falling onto or rolling over the cover portion 75. In addition, a plastic composition typically provides for ready release of concrete hardened in the slot 78. Plastics known in the art such as polyethylene, polypropylene, polyvinyl chloride (PVC), acrylonitrile-butadiene-styrene (ABS), and blends and copolymers thereof, may be selected for construction of the plug 20. Polyethylene is particularly well adapted for use in forming the plug 20 due to its waxy, self lubricating type properties that facilitates insertion and removal of the plug from the coring sleeve 18. the coring sleeve 18 and adaptor 16 are preferably formed from acrylonitrile-butadiene-styrene. As an alternative to the sticker, the upper surface 76 of the plug 20 may include a textured portion 80, as shown in FIG. 5, for receiving printed or written indicia.

FIG. 4 is a cross sectional view of the rough-in assembly of FIGS. 1 and 3 when assembled and surrounded by a poured concrete slab 10. The process or method for installing a drain 5 and connecting it to a vertically extending drain pipe 7 in association with pouring a slab 10 using the rough-in assembly 1 may be described as follows. The components of the rough-in assembly 1 are preferably assembled prior to attachment to a drain pipe 7. In particular, the coring sleeve 18 is threaded onto the adaptor 16 and the plug 20 is threaded onto the coring sleeve 18 such that the upper surface 76 of the plug 20 generally extends flush with the upper edge 67 of the receiver bowl 52. Typically, the plug 20 is screwed downward until a lower portion of the plug head 75 abuts the inner surface of the bowl 52. For example, FIG. 4 shows the plug 20 engaged with the coring sleeve 18 so that a bottom edge of the plug head 75 rests upon the annular flange 61 of the bowl 52. The plug 20 is preferably sized such that when the bottom edge of the plug head 75 rests upon annular flange 61, the upper surface 76 of the plug 20 generally extends flush with the upper edge 67 of the receiver bowl 52.

The hub 44 of the adaptor 16 is then slipped over the upper end of the drain pipe 7 and secured thereto using a solvent-based cement typically applied previously to the outside surface of the drain pipe 7 and the inside surface of the adaptor 16. The adaptor 16 should be oriented so that the trap primer port 49, if any, is oriented in an appropriate direction to align with a trap primer pipe 84. The level to which the upper edge of the assembly 1 (i.e. the upper edge 67 of the bowl 52 and/or the upper surface 76 of the plug 20) extends is adjusted by threadingly rotating the coring sleeve 18 relative to the adaptor 16 to generally match or adjust it to be even with the level to which the concrete slab 10 is to be poured. The height of the upper edge of the assembly 1 is typically adjusted to a level at which no portion of the plug 20 or coring sleeve 18 extends above the level to which the concrete is to be poured and finished in forming the slab 10.

Concrete is then poured and finished flush with the level of the upper edge of the assembly 1. For example, as shown in FIG. 4, the concrete forming the slab 10 is poured and finished to be coplanar with the upper surface 76 of the plug 20 and the upper edge 67 of the bowl 52. The upper surface 76 of the plug 20 may provide a reference point for use in finishing the concrete to the desired level surrounding the rough-in assembly. The level to which the concrete is poured may be adjusted to include a depression or recess in the floor surface surrounding the drain 5 to facilitate draining water into the drain 5.

After the concrete sets, the plug 20 is removed from the bowl cavity 53 which now provides a void in the concrete slab 10 as formed by the bowl 52 of the coring sleeve 18. As discussed above, the bowl cavity 53 is sized to receive the drain head 25 with the drain stem 34 extending in threaded engagement into the drain hole or bore 57 extending through the neck 51 of the coring sleeve 18. The plug 20 is removed by first punching a tool through the sticker 79 and advancing the tool into the slot 78, then rotating the tool 78 to unscrew the plug 20 from the coring sleeve 18.

Figure 7:
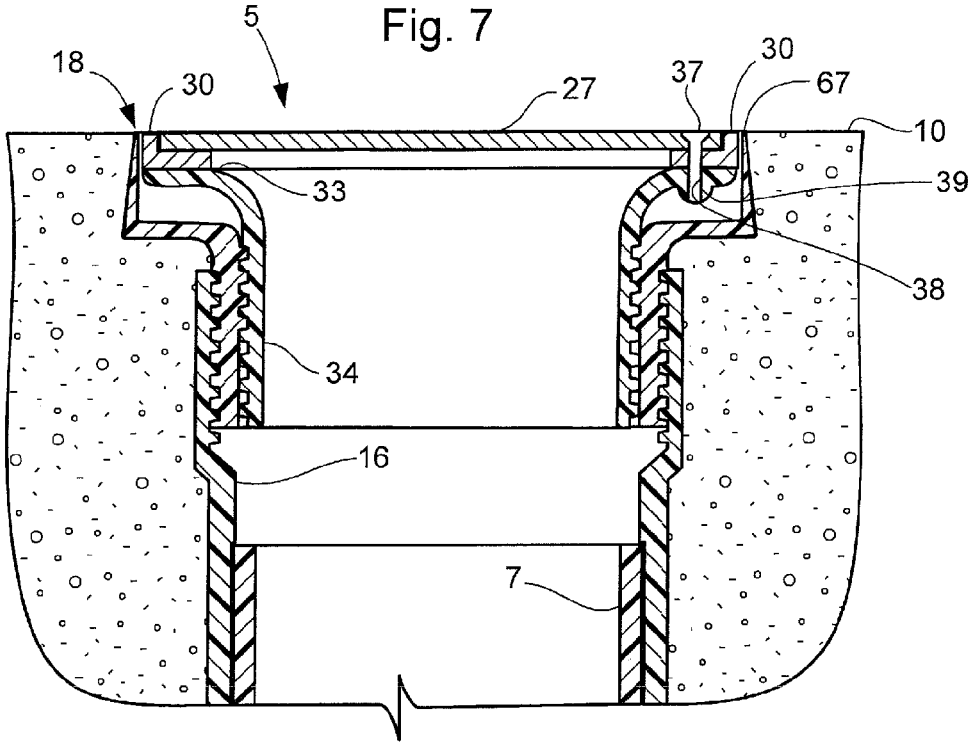
FIG. 7 is a cross sectional view of a floor drain installation system with a drain secured within a coring sleeve therein and after removal of the plug.

A drain 5 is then installed within the coring sleeve 18, as generally shown in FIG. 7, by threading the threaded neck 34 of the drain 5 into the internal thread 57 in the drain hole 54 of the coring sleeve 18. The drain 5 is threaded into the coring sleeve 18 until the upper surface of the drain 5 is positioned at the desired level, which might be flush with the level of the concrete slab 10 or a set distance above the slab 10 to accommodate the addition of a layer of tile or the like. Subsequent adjustment of the height of the drain 5 may be made by rotation of the drain 5 relative to the coring sleeve 18.

If the top of the drain 5 is to be coplanar with the concrete slab 10, the drain 5 is screwed downward, typically clockwise, until it is wholly within the bowl 52 of the coring sleeve 18 (assuming the top edge of the bowl is flush with the slab). If flooring is installed above the slab 10, the drain 5 may be unscrewed, typically rotated counter-clockwise, so that it is raised to the level of the flooring (see FIG. 14). The depth of the bowl cavity 53 is preferably greater than the thickness of the drain head 25 to permit the top of the drain 5 to be positioned below the upper edge 67 of the bowl 52 in case the bowl upper edge 67 extends above the level to which the concrete is poured and finished. Any portion of the bowl 52 extending above the concrete surface can then be cut away. Silicone or some other form of adhesive, cement or binder may be applied to the external thread 74 on the neck 73 of plug 20 to fix the relative position of the drain 5 to the coring sleeve 18 once the desired level of the drain 5 is obtained and once the silicone or other adhesive sets. Any gap between the drain head 25 and the receiver bowl 52 may be filled with grout or the like.

Figure 6:
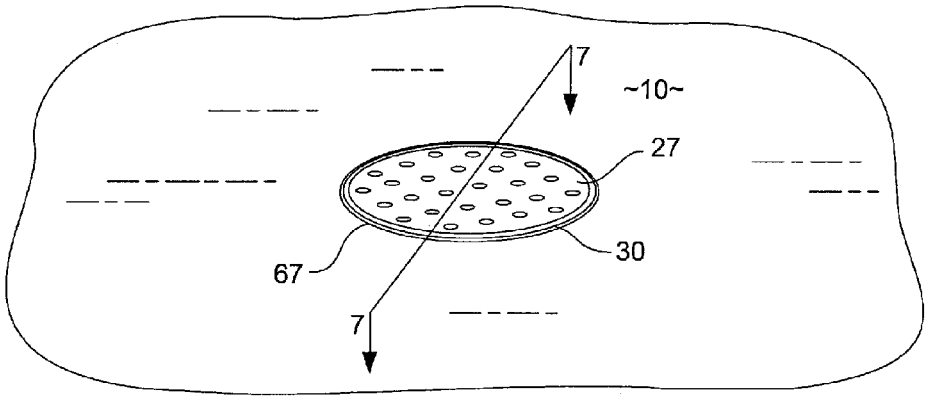
FIG. 6 is a perspective view of the floor drain installation system showing a drain head grate flush with the floor surface.

FIG. 5 is a perspective view of the floor drain installation assembly 1 of FIG. 1, installed and following the pouring and setting of an associated concrete floor slab 10, with portions of the surrounding slab 10 broken away to reveal system components. FIG. 6 is an environmental, perspective view of an installed floor drain 5 showing the drain head grate 27, drain head collar 30 and receiver bowl upper edge 67 flush with the upper surface of the slab 10. FIG. 7 provides a cross sectional view taken along line 7-7 in FIG. 6 of the drain 5 in its final position within the coring sleeve 18 after removal of the plug 20 and insertion of the drain 5.

Figure 9:
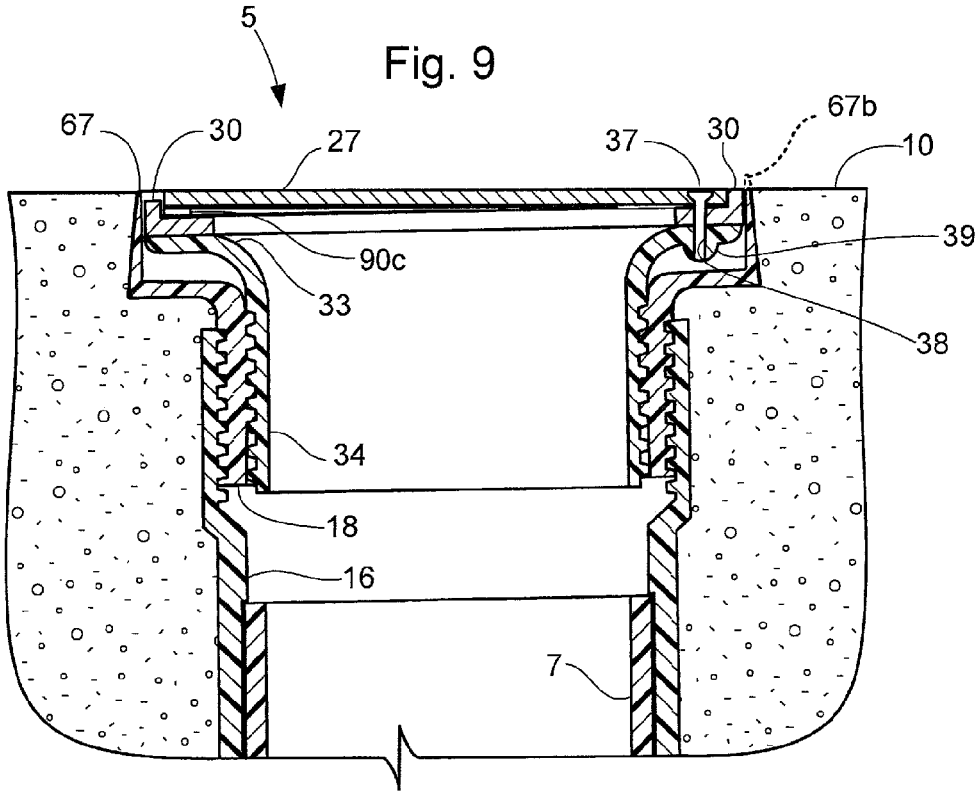
FIG. 9 is a cross sectional view similar to FIG. 7, wherein the drain pipe and attached system components deviate from a vertical orientation, showing the grate leveled flush with the floor through use of a leveling shim.
Figure 8A:
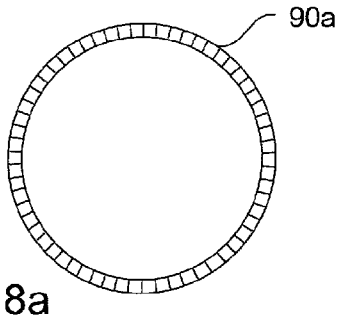
FIGS. 8*a-j* comprise top and side views of several embodiments of a leveling shim which can be utilized with the drain head.
Figure 8B:
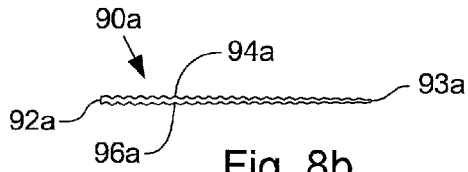
Figure 8C:
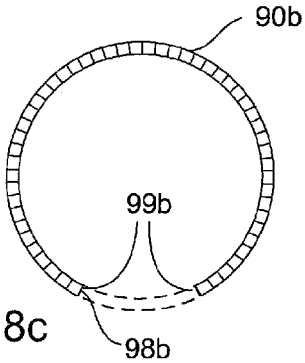
Figure 8D:
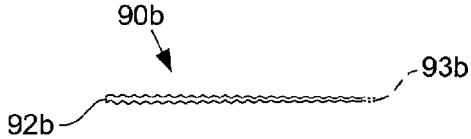
Figure 8E:
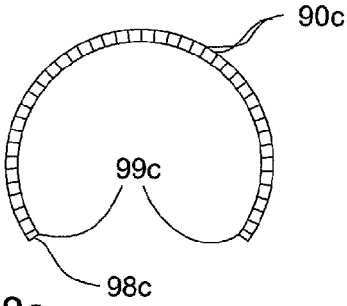
Figure 8F:
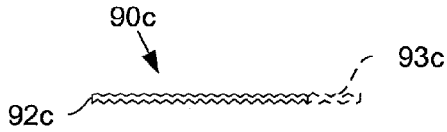
Figure 8G:
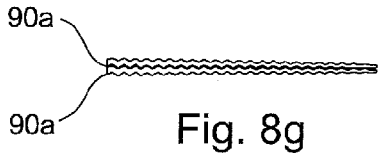
Figure 8H:
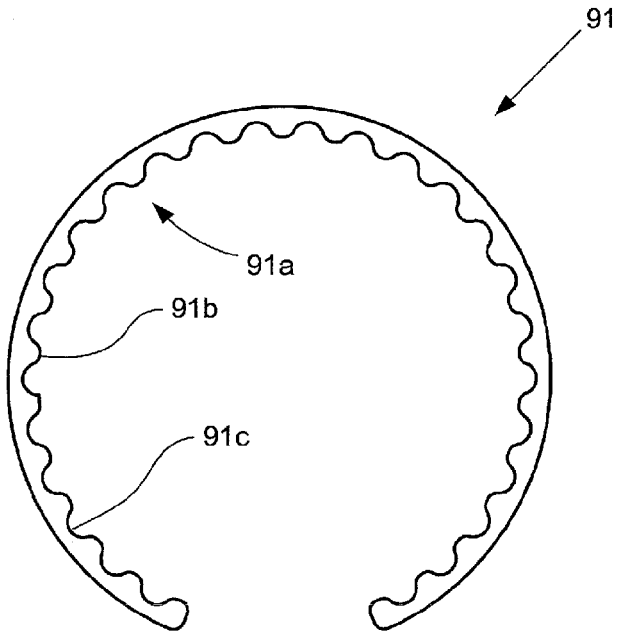
Figure 8I:
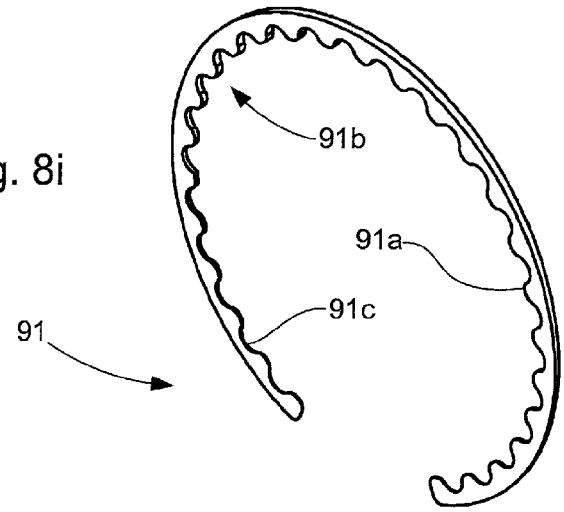
Figure 8J:
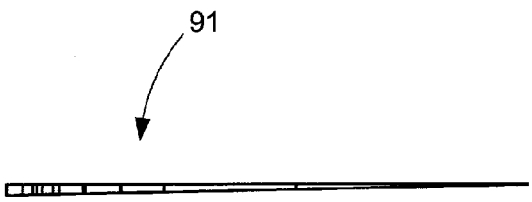

FIGS. 8*a* to 8*j* show several embodiments of a leveling shim 90 which may be used to level the drain head strainer 27 or the strainer 27 and collar 30 in situations where the drain pipe 7 and rough-in assembly 1 are not installed truly vertical, for example as is generally shown in FIG. 9. Referring first to FIGS. 8*a* to 8*g*, several embodiments of the leveling shim 90 are shown in top and side view with the various embodiments designated 90*a*, 90*b* and 90*c*. An alternative embodiment of a leveling shim 91 is shown in FIGS. 8*h-j*. As shown in FIG. 7, when the drain pipe 7, adaptor 16 and coring sleeve 18 are in a substantially vertical orientation, the strainer 27 of the drain 5 attached thereto extends in a substantially horizontal alignment simply through coupling of the drain 5 to the coring sleeve 18. When the drain pipe 7, and attached adaptor 16 and coring sleeve 18 deviate from a vertical orientation, however, the horizontal orientation of the strainer 27 will deviate correspondingly. It may be necessary or desirable, therefore, to cant or tilt the strainer 27 or the strainer 27 and collar 30 relative to the rest of the drain 5 to obtain an orientation of the strainer 27 that is closer to horizontal.

As shown in FIG. 9, the left edge of the strainer 27 has been raised by placing the thickest portion of a shim 90, such as shim 90*b*, between the side of the strainer 27 needing to be raised (the left side in FIG. 9) and the underlying portion of the drain head collar 30, thereby placing the strainer 27 in a generally horizontal orientation relatively flush with the surrounding upper surface of the slab 10. Alternatively, as shown in FIG. 16, a shim, such as shim 91, may be positioned immediately below the collar 30 and above the drain head flange 36 to level both the collar 30 and the grate 27 (or clean out cover) relative to the finished surface of the slab 10.

Each of the shims 90*a-c* is generally annular or ring-shaped. Shim 90*a*, for example, forms a complete ring that tapers in height when viewed from the side as in FIG. 8*b*, from a relatively thick side 92*a* (the left edge in FIG. 8*b*) to a relatively thin opposing side 93*a* (the right edge in FIG. 8*b*). As shown in FIG. 9, the placement of one or more shims 90*a* between the collar 30 and grate 27 may be used to tilt the grate into the desired position. A series of ridges 94*a* and grooves 96*a* is preferably formed on the upper and lower surfaces of each shim 90*a* to facilitate holding, in a selected orientation, a pair of shims 90*a* stacked on top of each other (FIG. 8*g*). The ridges 94*a* and grooves 96*a* on adjacent shims 90*a* interlock to prevent one shim 90*a* from sliding or rotating relative to the other shim 90*a*.

Shim 90*b* is semi-annular, instead of completely annular as in shim 90*a*, with an opening or gap 98*b* formed between opposed ends 99*b* of the semi-annular shim 90*b*. Shim 90*b* is also tapered from a thick side 92*b*, opposite the gap 98*b*, to a thin side 93*b* adjacent the opening or gap 98*b*. A significant advantage of semi-annular shim 90*b* over shim 90*a* is that the gap 98*b* provides the user with a visual reference as to which side is the thick side 92*b* and which side is the thin side 93*b*. Shim 90*b* presents a further advantage over shim 90*a* in that it may be installed around screws 37 already engaged between the strainer 27 and the drain head collar 30. Shim 90*c* presents a further embodiment having a larger gap 98*c* and a consistent thickness. Shims 90*a*, 90*b* and 90*c*, and related embodiments that may occur to one skilled in the art by this disclosure, may be used in multiples or in combination to achieve the desired orientation and positioning of the grate 27. For example, FIG. 8*g* shows a pair of shims 90*b* stacked on top of each other to increase the angle that the shims 90*b* will offset the grate 27 relative to the drain head collar 30.

With reference to FIGS. 8*h* to 8*j*, another embodiment of a leveling shim 91 is shown having a scalloped interior wall 91*a* comprising alternating ridges 91*b* and troughs 91*c*. The troughs 91*c* provide spaces for screws 29 to pass through from the strainer 27 to the drain head flange 36 and assist in holding the shim 91 in place and in keeping it from sliding out of position during assembly of the drain 5. When viewed from the side, as in FIG. 8*j*, it may be seen that the shim tapers from a relatively thick portion 9*d*, to a relatively thin portion 91*e* so that the strainer 27 and collar 30 can be titled relative to the drain head flange 36 to level the strainer 27 and collar 30 with the surrounding floor surface.

Referring to FIG. 9, when the rough-in assembly does not extend truly vertical, a portion of the receiver bowl 52 annular wall 63 may extend above the level of the finished slab 10. To avoid potential interference with foot traffic or overlying floor structures or treatments, the projecting portion 67*b* may be trimmed off with a knife or other device, particularly if the coring sleeve 18 is formed of plastic. In addition, the drain 5 may be lowered within the coring sleeve 18 to avoid projection of the right edge of the grate 27 above the slab surface 10. As discussed previously, the bowl 52 preferably is deeper than the thickness of the drain head 25 to provide sufficient space for receiving the drain head 25 completely within the bowl 52 even if a portion of the bowl 52 must be trimmed away.

Figure 11:
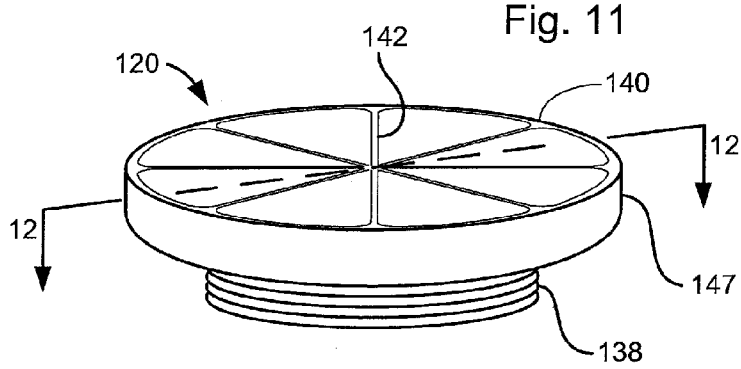
FIG. 11 is a front perspective view of the coring cap of FIG. 10.
Figure 12:
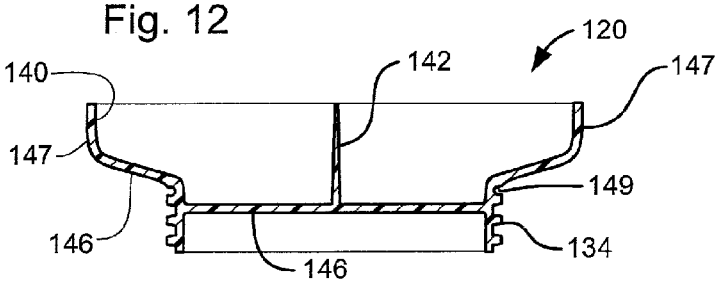
FIG. 12 is a section of the cap of FIGS. 10 and 11 taken through line 12-12 of FIG. 12.
Figure 13:
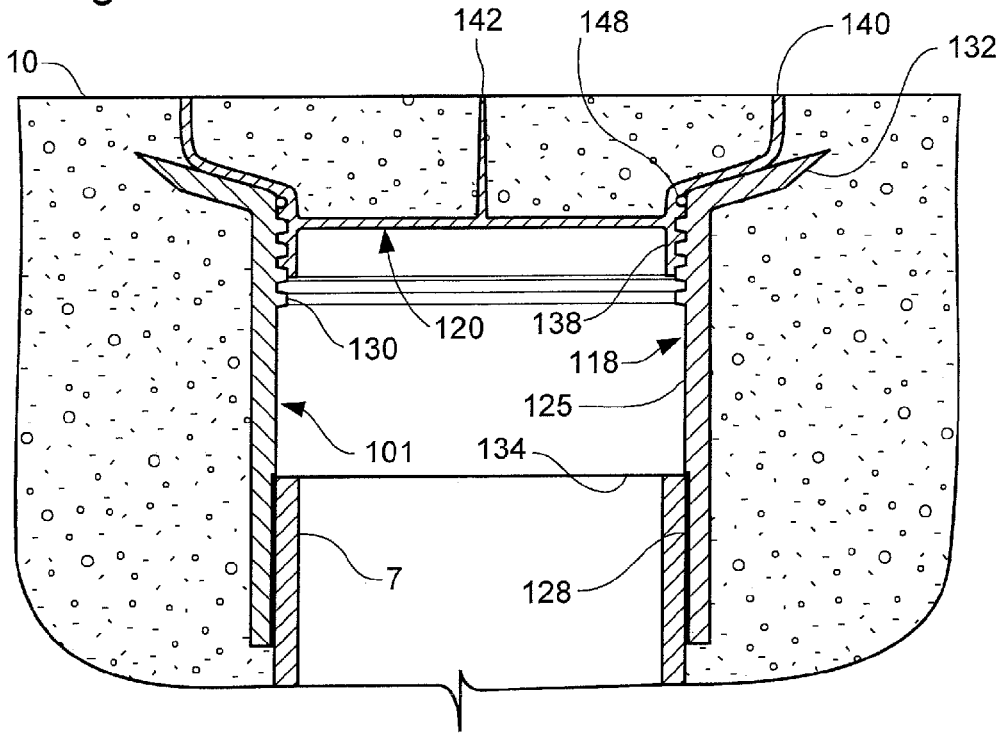
FIG. 13 is a cross sectional view of an alternative embodiment of the floor drain installation system utilizing the coring cap of FIGS. 10-12 to provide a void for later reception of the drain head.

Turning to FIGS. 10 through 14, an alternative embodiment of the floor drain mounting assembly is indicated by reference numeral 101 and shown in cross-section in FIG. 13. The assembly 101 includes a drain receiver 118 which mounts directly to the drain pipe 7 and a concrete coring cap 120 threadably engaged within the receiver 118.

The receiver 118 presents a hollow, cylindrical body 125 with a mounting hub 128 formed in a lower end thereof, an internal thread 130 formed in an upper end thereof and a flange 132 extending radially outward and upward from the upper end of the cylindrical body 125. The mounting hub 128 is sized for relatively snug securement over the end of the drain pipe 7. An upper end of the hub 128 is defined by an annular shoulder or stop 134 formed on the inner surface of the receiver body 125.

Figure 10:
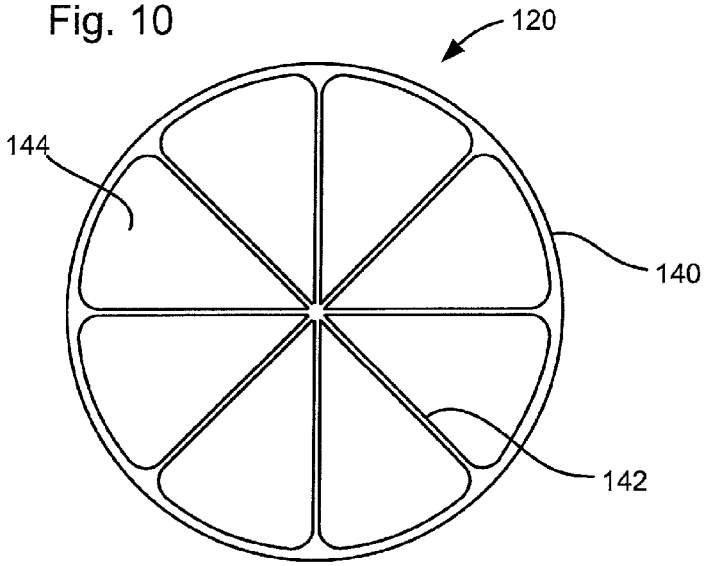
FIG. 10 is a top view of an alternative embodiment of a coring cap utilized in an alternative embodiment of the drain head installation system.

The cap 120, as shown in detail in FIGS. 10-12, includes a threaded stem or neck 138 and a bowl 140 formed at an upper end of the stem 138 and projecting radially outward therefrom. The neck 138 is of a reduced diameter relative to the bowl 140 and is sized for receipt within the upper end of the receiver body 125 and through threaded engagement with the internal thread 130. Radially extending dividers 142 extend across the interior of the bowl 140 providing strength and rigidity and dividing the bowl 140 into a plurality of pie shaped sections or chambers 144.

In use, the coring cap 120 may be preloaded onto the receiver 118. The receiver 118 is then slid onto and secured to the drain line 7 by cementing it thereto. The cap 120 may be secured to the receiver 118 such that a floor 146 of the cap 120 abuts against the receiver flange 132 and an outer wall 147 of the cap projects upward therefrom. Once the receiver 118 is secured to the drain line 7, the cap 120 may be rotated relative to the receiver 118 to adjust the level of the upper edge of the cap 120 to correspond to the level to which the concrete slab 10 is to be finished. An O-ring 148 may be placed around the cap stem 138 to form an air-tight seal between the cap 120 and the receiver 118 permitting pressure testing of the drain line prior to installation of the drain 5. Referring to FIG. 12, the cap 120 may include a notch 149 or other means for securing the O-ring 148 to the surface of the stem 138.

After pressure testing of the drain line 7 and assembly 101, concrete is poured around the assembly 101 and finished to the desired level to form the slab 10. During pouring, concrete enters the pie-shaped chambers 144 of the bowl 140 so that once the concrete hardens, the filled cap 120 presents a continuous surface over which wheeled vehicles, carts or the like may readily traverse or roll during the construction of the remaining portions of the structure on top of the slab 10. Once construction is complete, and it is desired to install the drain 5, the concrete is first removed from the pie shaped chambers 144 of cap 120 with a screw driver or the like and possibly by first breaking the concrete in the cap 120 into smaller pieces. After the concrete is removed from the pie shaped sections 144 of cap 120, an end of a tool may be inserted into the cap 120 to provide leverage to unscrew and free the cap 120 from the surrounding concrete. A release material may be applied to or wrapped around an outer surface of the cap 120, to facilitate release of the cap 120 from the concrete slab 10.

Removal of the cap 120 from the receiver 118 leaves a bowl-shaped void or recess 152 in the concrete slab 10, sized to receive a drain 5. The drain 5 is secured to the receiver 118 by threading the neck 34 of the drain 5 into the receiver 118 and onto internal thread 130. The level of the drain 5 can then be adjusted by rotating the drain 5 up or down within the receiver 118.

Figure 14:
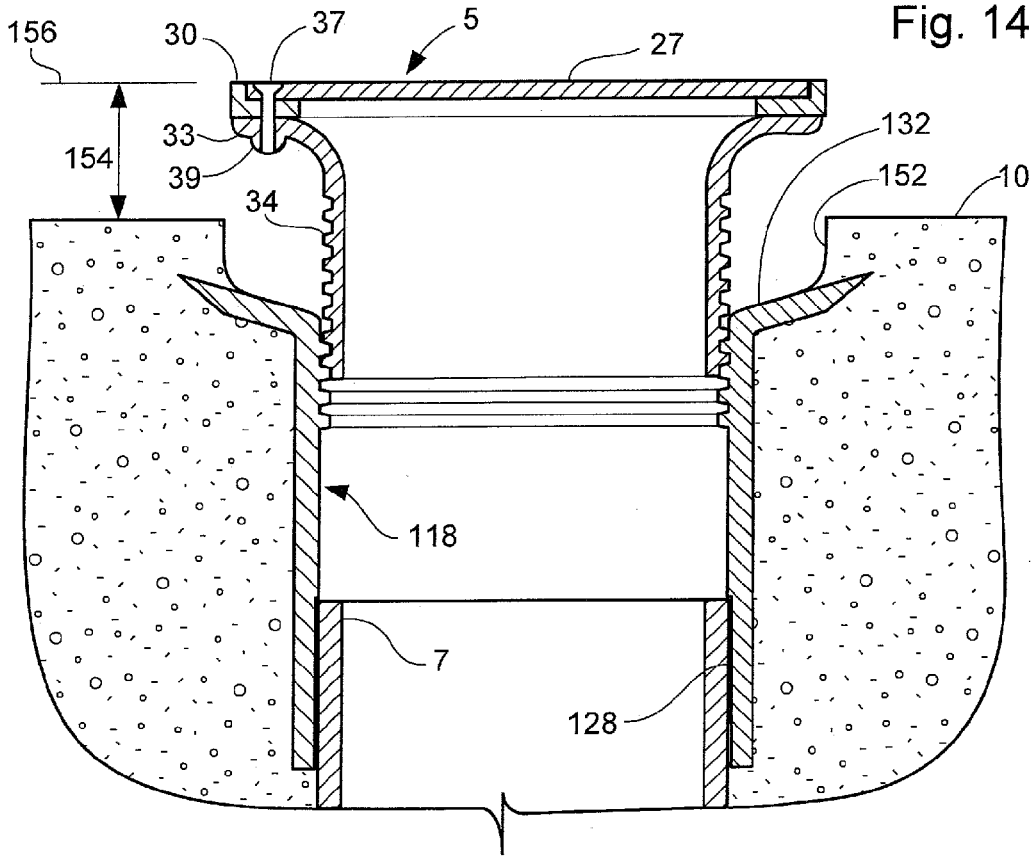
FIG. 14 is a cross sectional view of the embodiment illustrated in FIG. 13 with a drain partially engaged with the coring sleeve or receiver.

FIG. 14 is a cross sectional view of the floor drain installation system illustrated in FIG. 13 with a drain 5 partially engaged with the receiver 118. It should be appreciated that the drain 5 may positioned relative to the receiver 118 such that an upper surface of the drain 5 is spaced a selected distance 154 above the surface of the slab 10 so that the drain head upper surface will extend flush with the surface of flooring material to be installed on top of the slab 10. The upper surface of the flooring material is represented by line 156 in FIG. 14. Alternatively, the drain 5 may be further engaged with the receiver 118, typically by rotating the drain 5 clockwise, until the drain 5 is held within the void 152 and the upper surface of grate 27 is flush with the surface of the slab 10. As is also seen in FIG. 14, the receiver flange 132 functions to direct any water flowing between the drain 5 and the slab 10 back into the drain coring sleeve 18 and to the drain line 7.

FIGS. 15 through 17 illustrate alternative embodiments of certain components of the floor drain installation system as shown in FIG. 1. FIG. 15 illustrates components engaged with a drain pipe 7 prior to pouring a concrete slab 10 including an adaptor 160 that is connected to the upper end of the drain pipe 7, a coring sleeve 18 connected to the upper portion of the adaptor 160, and a slightly modified version of the plug 20 removably connected to the upper portion of the coring sleeve 18 to close off the internal passage or bore that runs through the coring sleeve 18, adaptor 160 and drain pipe 7.

Figure 18:
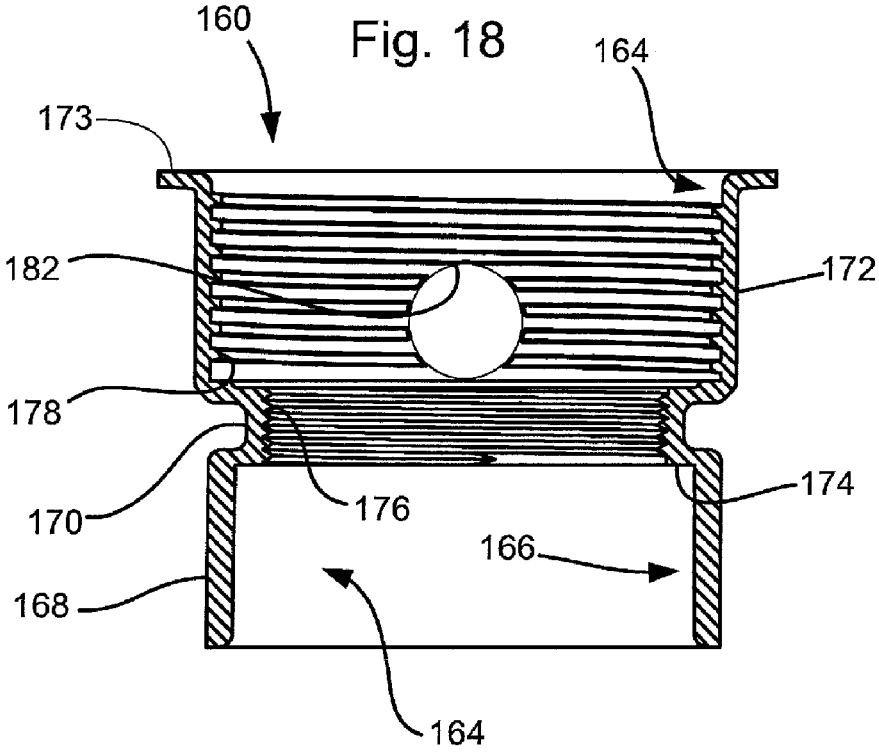
FIG. 18 is a cross sectional view of the adaptor shown in FIG. 15 taken generally along line 18-18 in FIG. 15.

The adaptor 160, shown in FIG. 15, is illustrated in further detail in FIG. 18 includes a generally cylindrical body 162 with an internal bore 164 therethrough and an internal wall 166. A lower portion of the adaptor 160 generally comprises a smooth-walled hub 168 sized for external engagement over a drain pipe 7 in a manner similar to that described previously for adaptor 16. A channel 170 around the exterior circumference of the body 162 (see FIG. 18) divides the hub 168 from the upper portion 172 of the adaptor 160 and is coincident with a ridge or internal shoulder 174 formed within the bore 164. The shoulder 174 defines the upper end of the hub 168 and includes internal threads 176 for engagement with auxiliary plumbing fixtures or other devices. The lower surface of the shoulder 174 acts as a stop against the end of the drain pipe 7 as the adaptor 160 is slid onto and in engagement with the drain pipe 7.

An internal thread 178 formed in the upper portion 172 of the adaptor 160 may be used for connecting the coring sleeve 18 to the adaptor 160. A lip 173 projecting radially outward from the upper end of the upper portion 172 presents an upward facing horizontal surface that may contact the lower surface of the annular flange 61 of the coring sleeve 18 to form a seal. The seal may be augmented by applying caulk to the upper surface of the lip 173 prior to tightening the coring sleeve 18 flange 60 against the lip 173.

A trap primer port 182 is located in the wall of the upper portion 172 so that the drain pipe 7 may be sealed separately from the primer port 182 through engagement of a threaded plug (not shown) with the internal threads 176 on the shoulder 174. Through this configuration, the drain system may be pressure tested apart from, and without the need for sealing, the primer port 182 and any associated plumbing pipe leading to the port 182.

Figure 19:
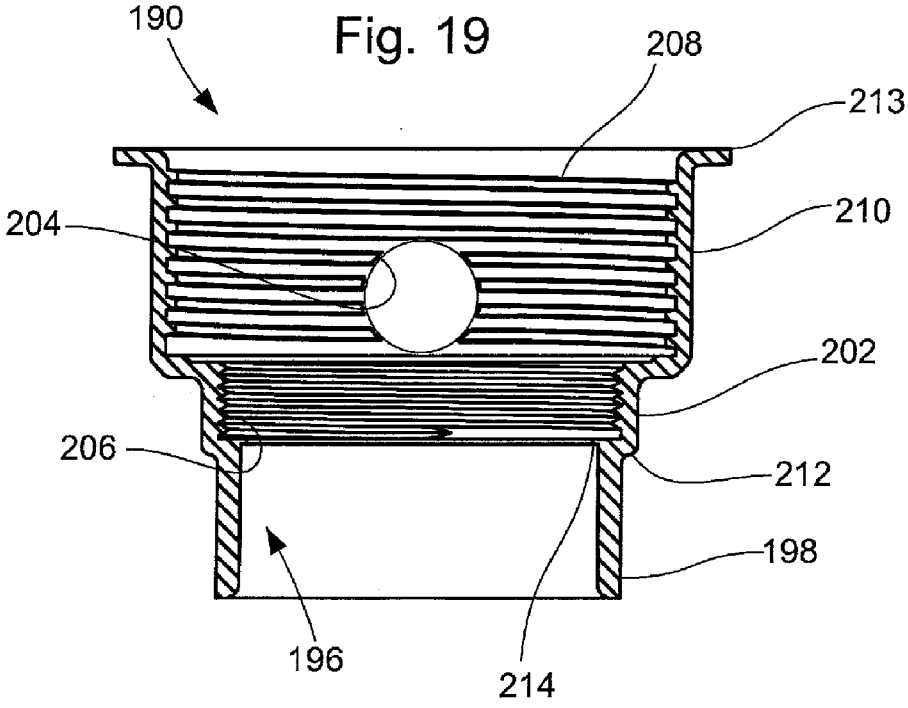
FIG. 19 is a cross sectional view similar to FIG. 18 showing an alternative embodiment of the adaptor shown therein.

FIG. 19 illustrates an alternative embodiment of the adaptor 190 similar the adaptor 160 described above. The adaptor 190 includes a generally cylindrical body 192 with an internal bore 194 therethrough and an internal wall 196. The lower portion of the adaptor 190 comprises a smooth-walled hub 198. The adaptor 190 differs from adaptor 160 in that the hub 198 is sized for internal, rather than external, engagement within a drain pipe 7. Alternatively, the hub 198 could be used to externally engage a drain pipe 7 having a relatively small external diameter.

Due to the reduced diameter of the hub 198 relative to the middle portion 202, an exterior shoulder 212 is formed that, in a manner similar to that of internal shoulder 174 in adaptor 160, acts as a stop to limit travel of the drain pipe 7 when engaged with the adaptor 190. As the hub 198 is slid inside a drain pipe 7 the end of the drain pipe 7 will come to abut the shoulder 212 at the point of full engagement.

Because the lower portion or hub 198 is reduced in diameter from middle portion 202, however, a shoulder surface is not created in the interior of the adaptor 190 at the interface or juncture of the hub 198 and middle portion 202, as with adaptor 160. Therefore, to provide such a surface should the adaptor 190 be required to fit over a drain pipe 7 with a smaller diameter than the bore 194 within the hub 198, an internal shoulder 214 may be provided as a ridge projecting vertically and inwardly from the upper interior wall of the hub 198 into the bore 196 to provide a stop to prevent further upward passage of the drain pipe 7 within the adaptor 190.

A further embodiment of the assembly, as shown in FIG. 17, includes a flashing drain or shower pan drain adaptor 220 in place of the adaptor 160 in the assembly shown in FIG. 15. The adaptor 220 is generally cylindrical and includes an internal bore 222 therethrough. The adaptor 220 differs from the embodiments disclosed above in that the upper end of the adaptor 220 is surrounded by an extended flange or pan 224 that projects outward and upward. The lower portion of the adaptor 220 includes a hub 226, similar in design to those disclosed above, for engagement with the drain line 7. A trap primer port 228 may be included in the upper portion of the adaptor 220.

A clamping ring 230 is provided for clamping and securing flashing (not shown) between ring 230 and the pan 224. Flashing may thereby held in place by the adaptor 220 during pouring of a surrounding concrete floor slab. The flashing assists in capturing water or other liquid that seeps downward along the exterior of the drain assembly 5 and directing it into the drain pipe 7.

Figure 20:
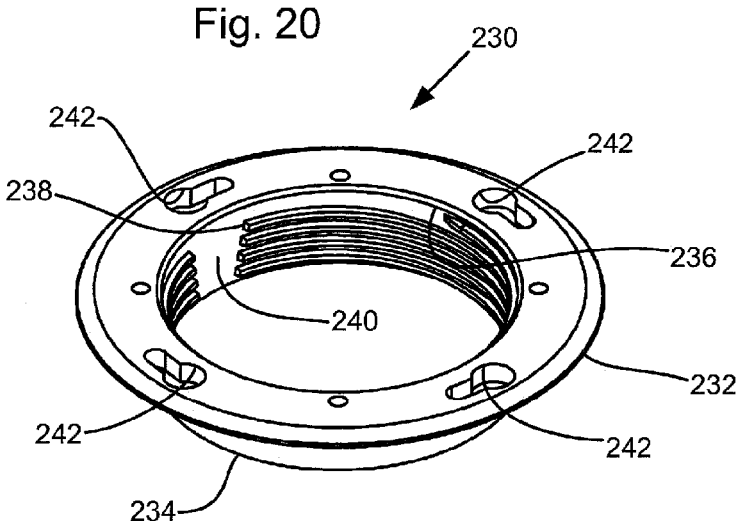
FIG. 20 is an enlarged perspective view of a clamping ring from the assembly shown in FIG. 17.
Figure 21:
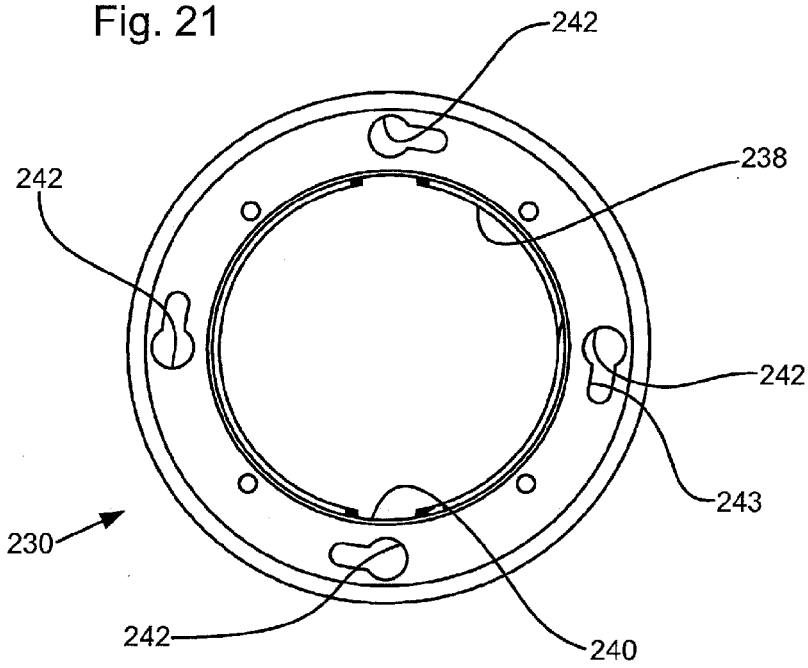
FIG. 21 is a top plan view of the clamping ring of FIG. 20.

FIGS. 20 and 21 provide enlarged illustrations of the clamping ring 230. The ring 230 includes a generally horizontal flange 232 projecting radially outward from a generally cylindrical base 234 having a bore 236 therethrough. The internal wall of the ring 230 includes threads 238 that, in the illustrated embodiment, are divided into segments or sections separated by open spaces 240. Due to the arrangement of these segments and open spaces 240, a fitting, such as an adaptor 160, with external threads divided into segments having an arcuate length corresponding to the arcuate length of the open spaces may simply be lowered into the body of the clamping ring 230 to the desired depth and then turned to engage threads on the fitting with corresponding threads 238 in the ring 230. This greatly speeds assembly of a fitting with the disclosed ring 230 since multiple turns of the fitting are not normally required to bring it into full engagement with the ring 230. Rather, after lowering the fitting into the ring 230, less than a full turn of the fitting is normally required to attain full engagement.

To facilitate attachment of the clamping ring 230 to the adaptor 220 as generally shown in FIG. 17, holes 242 are provided in the clamping ring flange 232 that may be aligned with corresponding threaded holes 229 in the flange 224 of the adaptor 220. After the ring 230 is placed so that the base 234 fits within the bore 222 of the adaptor 220, threaded screws 244 are passed through holes 242 and then tightened to threaded engagement within holes 229. The ring 230 may be turned slightly, to engage each screw 244 with the narrowed, slot portion 243 of each corresponding clamping ring hole 242.

Figure 22:
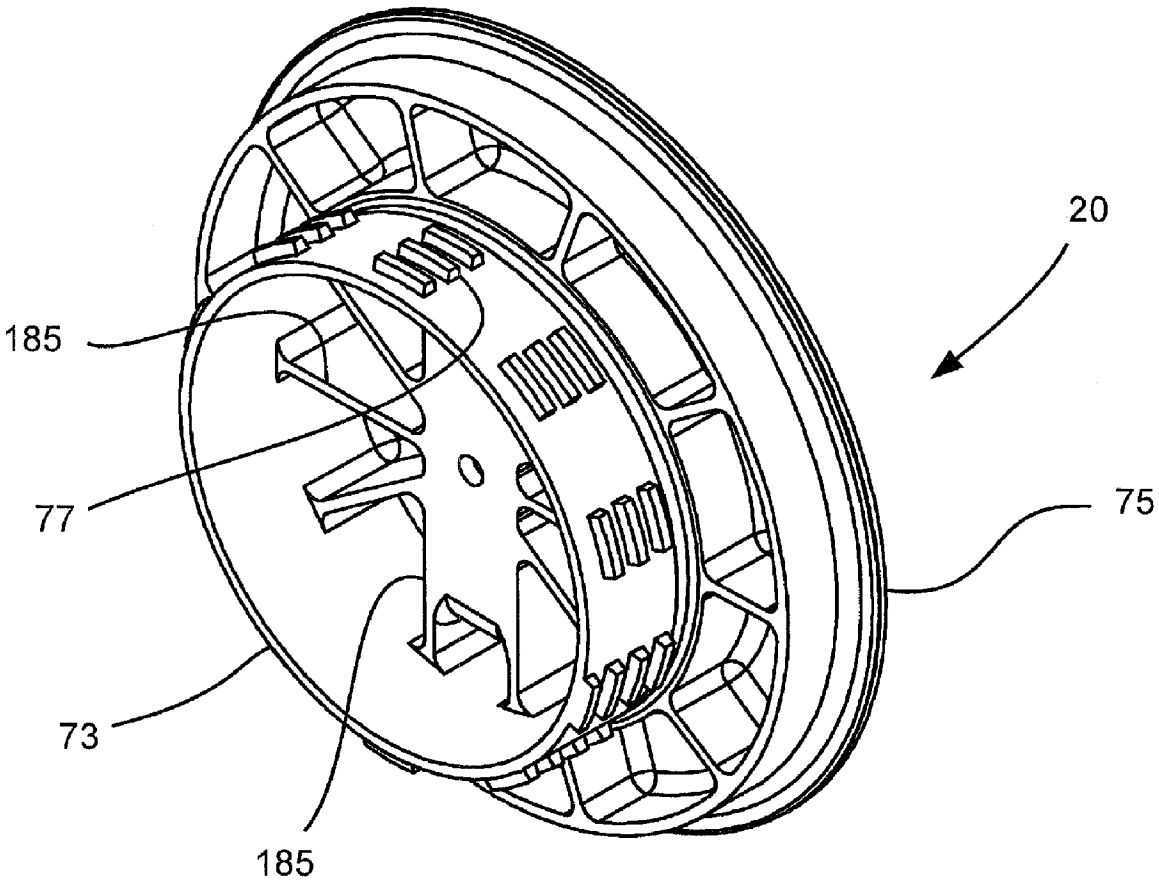
FIG. 22 is an enlarged rear perspective view of a coring plug from the assembly shown in FIG. 15.

Turning to FIGS. 15 and 22, the plug 20 illustrated differs from the previously described plug 20 in that the threads 74 are non-contiguous but project in spaced sections about the neck of the plug to offer less frictional resistance when the plug 20 is later removed (unscrewed) from the coring sleeve 18. In addition, the coring sleeve 18 may be provided with correspondingly segmented threads so that the plug 20 can be inserted fully into the coring sleeve 18 by passing the threads 74 of the plug 20 past spaces between receiver thread segments (not shown), the plug 20 then being tightened in place typically without having to turn the plug 20 more than a full turn. Rigid, spaced partitions or webbing 185 on the underside of the plug 20 enhance the overall strength and rigidity of the plug 20 while minimizing weight.

Figure 23:
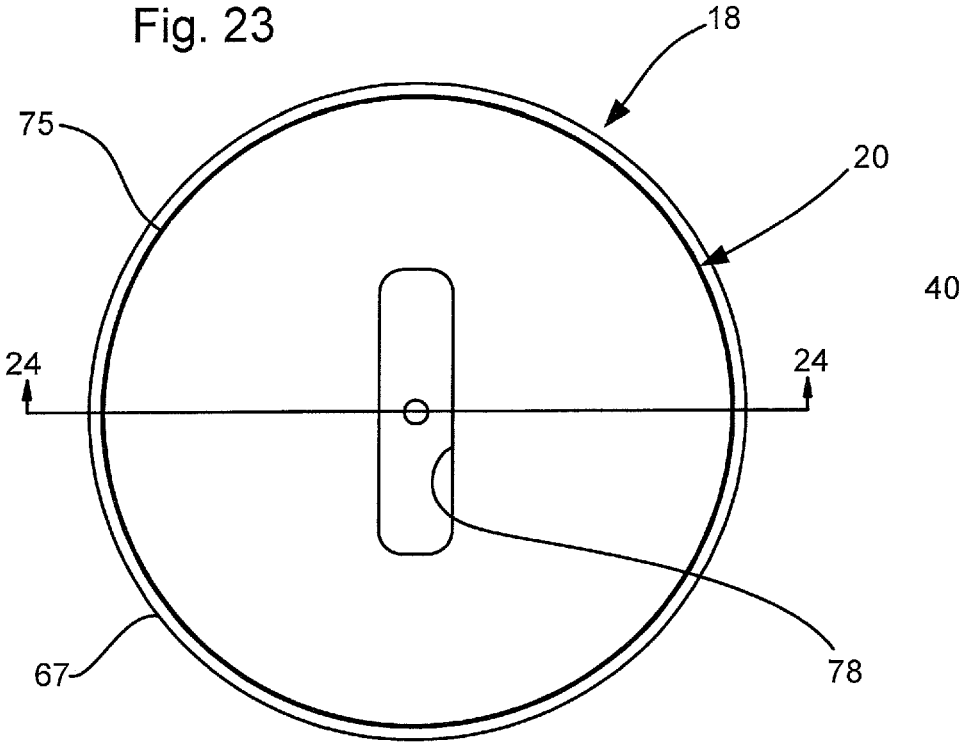
FIG. 23 is a top plan view of a coring plug engaged with a floor drain installation system.
Figure 24:
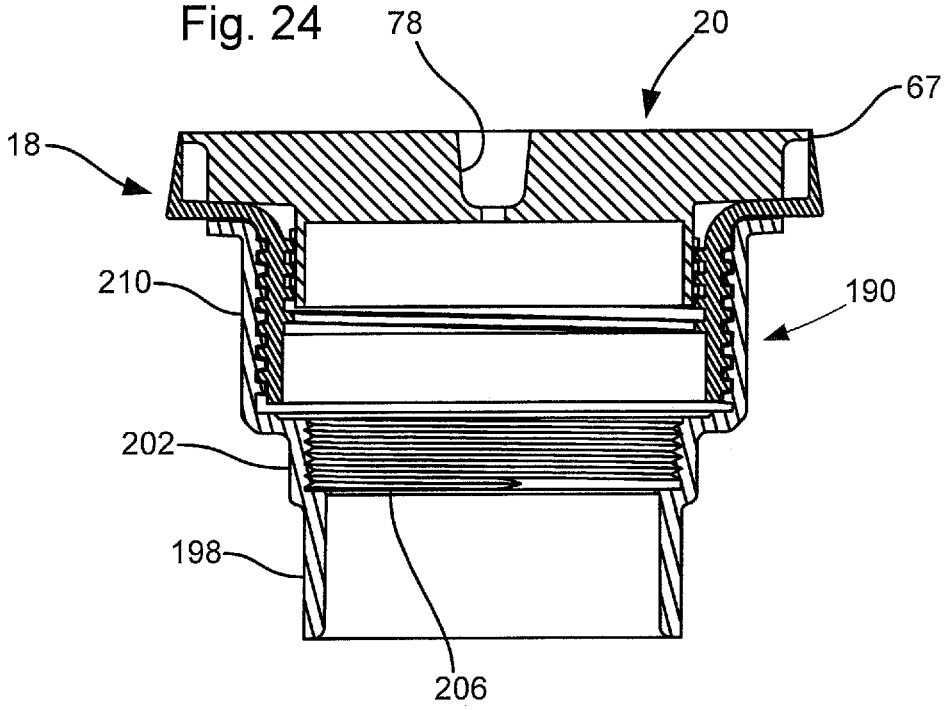
FIG. 24 is cross sectional view of the assembly of FIG. 23 taken along line 24-24 in FIG. 23.
Figure 25:
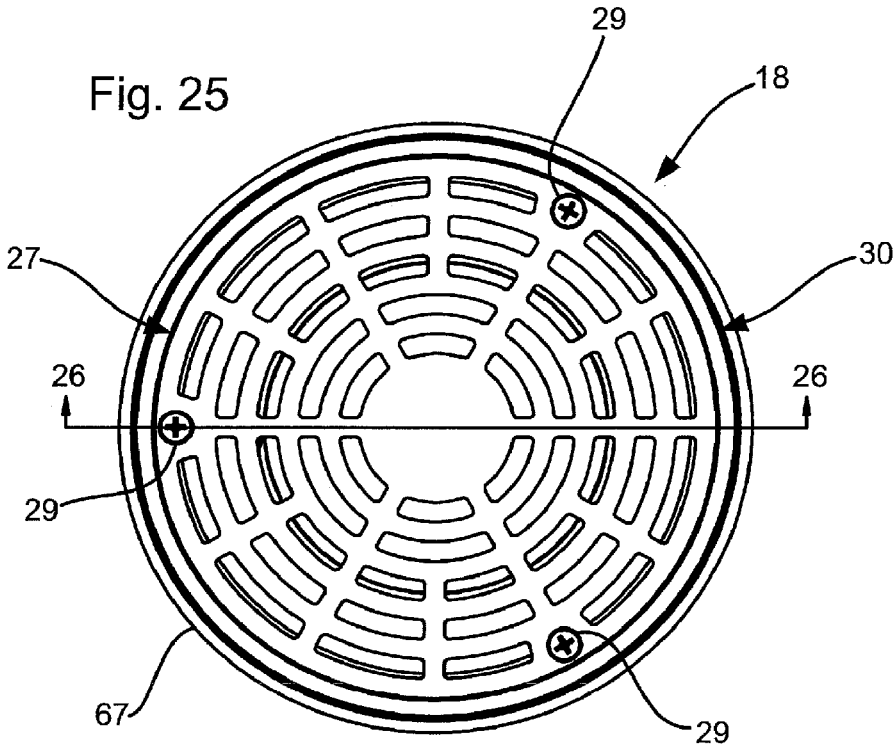
FIG. 25 is a top plan view of a drain engaged with a floor drain installation system.
Figure 26:
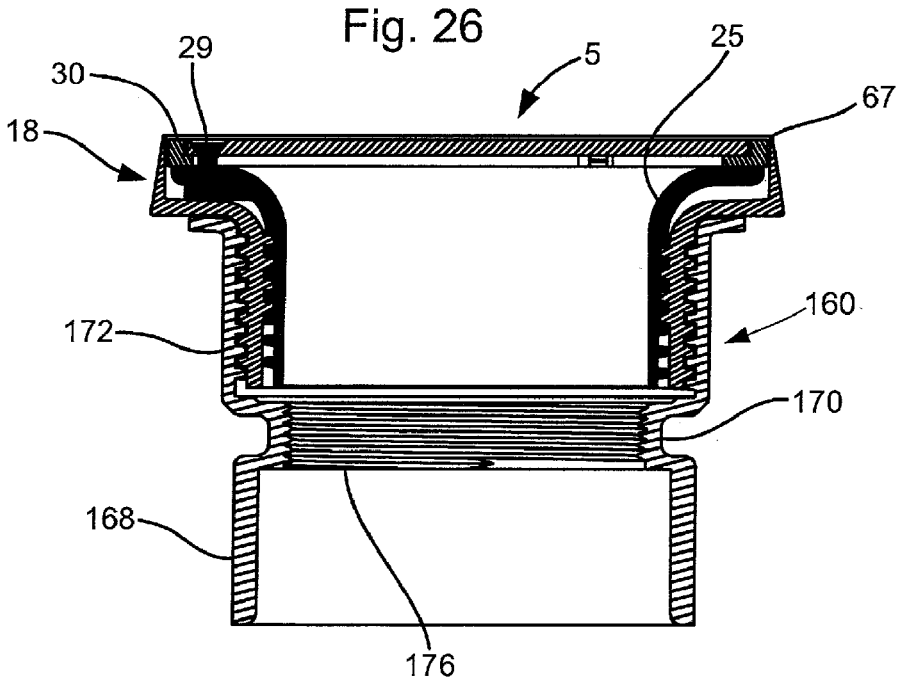
FIG. 26 is a cross sectional view of the assembly of FIG. 25 taken along line 26-26 of FIG. 25.

FIG. 23 is a top plan view of the plug 20 engaged within the coring sleeve 18 as further illustrated in cross section along lines 24-24 in FIG. 24. In FIG. 24 the coring sleeve 18 is shown in full engagement with adaptor 190 and the plug 20 is shown in full engagement with the coring sleeve 18. FIG. 25 is a top plan view of the drain assembly 5 engaged within the coring sleeve 18 as further illustrated in the cross sectional view of FIG. 26 taken along lines 26-26 in FIG. 25. In FIG. 26 the coring sleeve 18 is shown in full engagement with adaptor 160 and the drain assembly 5 is shown engaged within the coring sleeve 18 so that the strainer 27 is level with the upper lip 67 of the coring sleeve 18.

Figure 27:
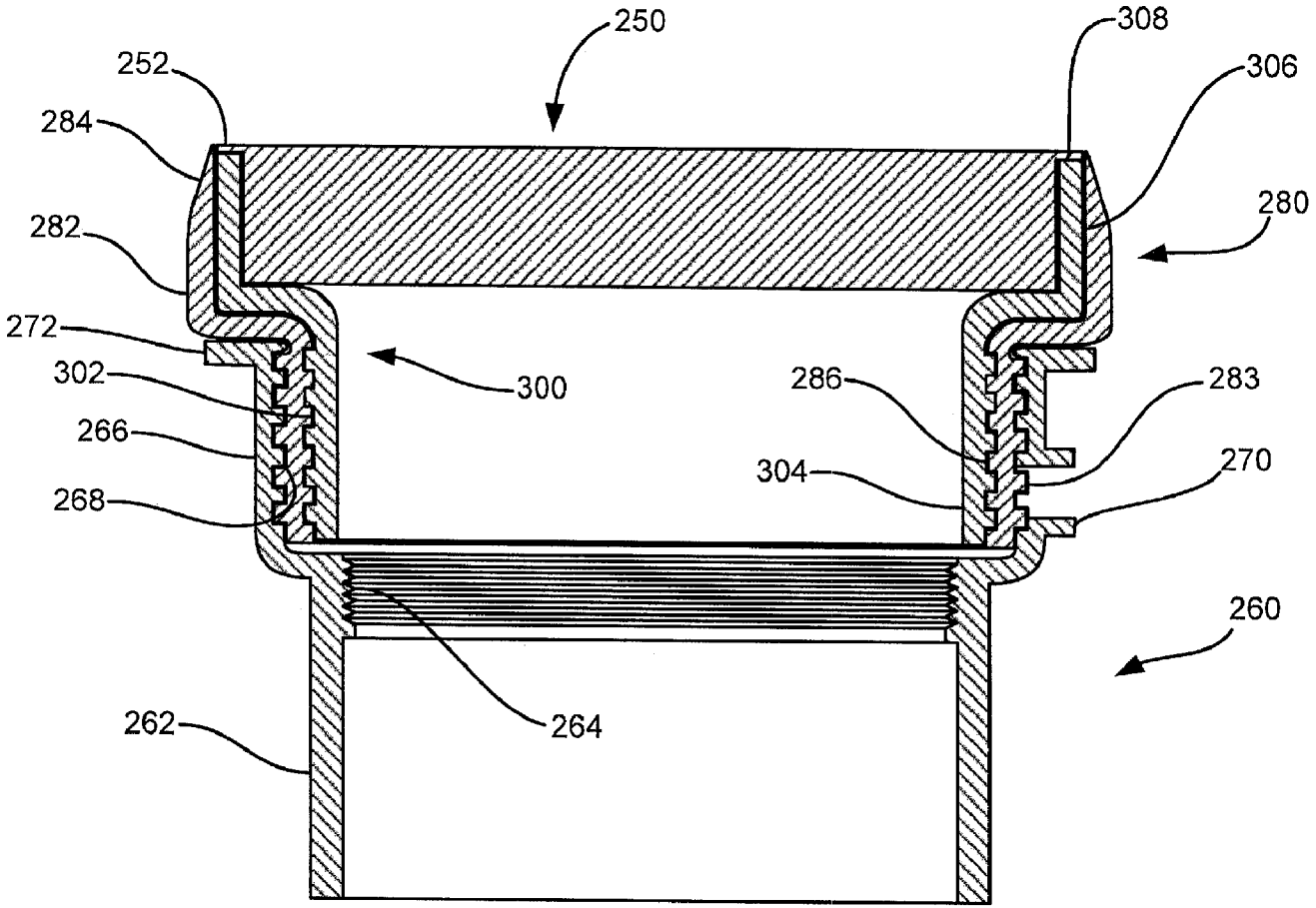
FIG. 27 is a cross sectional view of a floor drain installation system similar to FIG. 24 illustrating use of a solid coring plug and a coring insert.

FIG. 27 illustrates several further variations of the invention including a solid coring cap or plug 250, cast or shaped from plastic or other appropriate material, an adaptor 260, similar in design to adaptors 160 and 190, a coring sleeve 280 having a relatively vertical annular wall 282, and a coring insert 300 that may be threadably engaged within the coring sleeve 280.

As shown, the adaptor 260 includes a smooth-walled hub 262 in the lower portion of the adaptor 260, a middle portion having internal threads 264 for engagement with a plug or other fixture (not shown), and an upper bowl 266 having internal threads 268 sized to mesh with the external threads 283 of the coring sleeve 280. As illustrated, a trap primer port 270 is provided in the wall of the upper bowl 266. A flange 272 projects outward from the top edge of the bowl 266 to contact the coring sleeve 280 when the coring sleeve 280 is in full engagement with the adaptor 260.

The coring sleeve 280 is similar in construction and function to the previously described embodiment of a coring sleeve 18. The exterior surface of the upper portion 284 of the wall 282 drafts or tapers inward as it approaches the upper edge of the wall 282. In a manner similar to coring sleeve 18, this inward draft causes the coring sleeve 280 to be "locked" into position once is poured around the coring sleeve 280 and allowed to harden.

The coring insert 300 has external threads 302 about a lower, generally cylindrical base 304 that engage with internal threads 286 that run along the interior wall of the coring sleeve 280. The coring insert 300 has an upper bowl portion 306 that comprises an annular wall 308, the bowl being sized to accept the plug 250. The coring plug 250 sets within the coring insert 300 so that an outer portion 252 of the plug 250 overlies the upper edge of the wall 308. After a surrounding concrete floor slab has been poured and allowed to harden, the coring plug 250 and coring insert are removed and replaced with a drain assembly 5 or other plumbing fixture.

Figure 28:
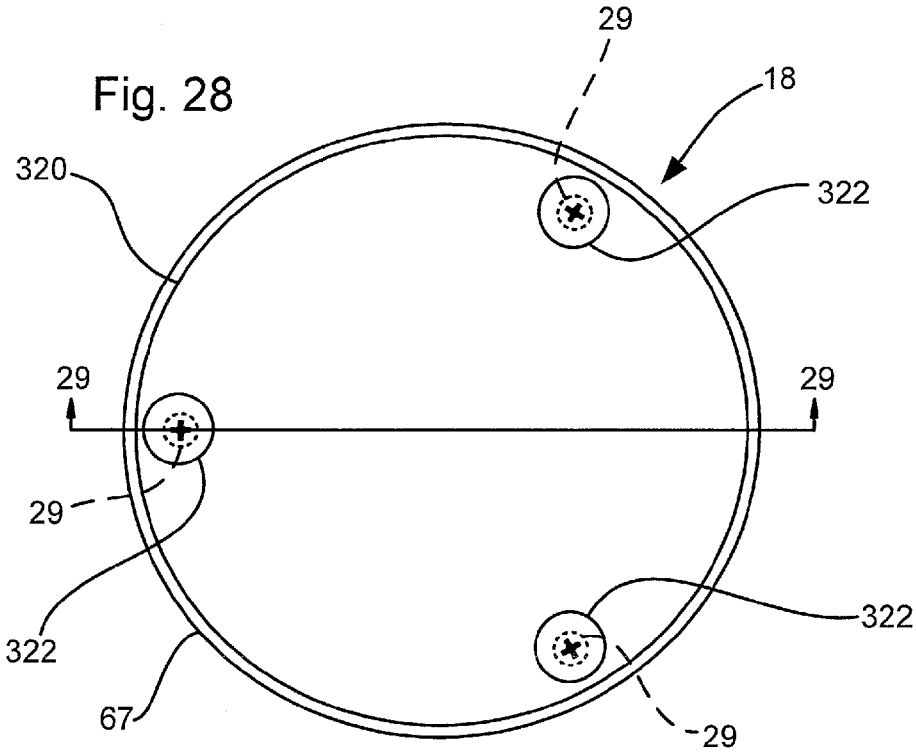
FIG. 28 is a top plan view of an alternative embodiment showing a removable disc shaped cover secured to a drain received within a coring sleeve of the floor drain installation system.
Figure 29:
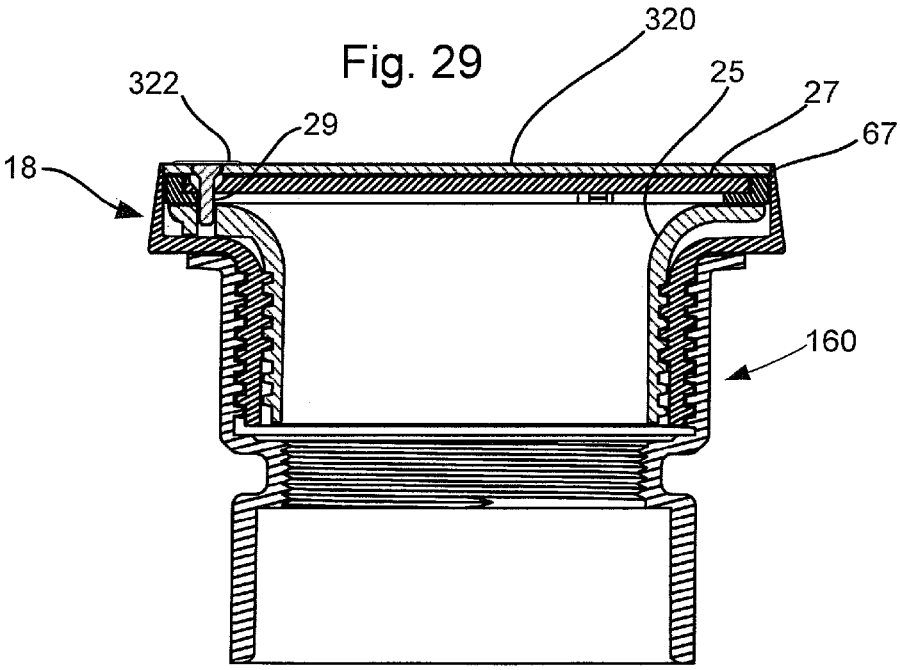
FIG. 29 is cross sectional view of the assembly of FIG. 28 taken along line 29-29 in FIG. 28.

FIGS. 28 and 29 illustrate an alternative embodiment in which the coring plug 20 is replaced by a relatively thin, flat, circular or disc shaped cover 320 attached to either the coring sleeve 18 or, as illustrated, to the drain 5. The drain 5 may therefore be installed within the coring sleeve 18 prior to pouring the surrounding floor slab 10. As illustrated, the cover 320 may be attached to the drain 5 by passing screws 29 through holes provided in the cover 320 and then threading the screws 29 through the grate 27 and into the drain head flange 25. Small, circular stickers 322 may then be affixed over the heads of the screws to protect them during pouring and finishing of the slab 10 and more specifically to keep concrete out of the screwdriver receiving grooves in the heads of the screws 29. After the slab 10 has hardened sufficiently, the stickers 322 are peeled off, the screws 29 are removed, the cover 320 is removed and saved for reuse or discarded, the screws 29 are re-threaded into the grate 27 and drain head flange 25 to secure the drain head 5 elements to one another, and the drain 5 is rotated relative to the coring sleeve 18 so as to raise the drain 5 to a desired level relative to the coring sleeve 18 and/or floor surface.

The cover 320 is typically a thin plastic disk having a diameter equal to or slightly less than that of the top opening of the bowl cavity 53 in the coring sleeve 18. The cover 320 preferably extends across substantially the entire bowl cavity 53 to engage or extend in close proximity to an inner surface of the coring sleeve 18 along the upper edge 67 of the bowl cavity 52 to prevent concrete or cement from passing between the cover 320 and the rim 67 of the coring sleeve 18. Typically, the cover 320 will have a thickness of between 1/10 and 1/4 inches. As with the coring plug 20, a portion of the top surface of the cover 320 may be textured to accept ink or pencil markings or such indicia may be printed on a sticker adhered to the cover 320. The screws 29 used to hold the cover 320 in place may be the same, typically metal, screws 29 used to attach the grate 27 to the drain head flange 25. Alternatively, plastic screws may be provided to attach the cover 320 to the drain head flange 25. The plastic screws are then replaced by the metal screws when the cover 320 is removed and the grate 27 is secured to the drain head flange 25. As further alternatives, the cover 320 may be attached directly to the grate 27 using adhesive, double faced tape, or the cover 320 may be constructed to snap in place within or over the receiver rim 67.

As an alternative embodiment of the cover 320, one large, typically circular, piece of adhesive backed plastic film (not shown) may be applied over the grate 27 to extend past the juncture of the grate 27 and receiver rim 67, thereby protecting the grate 27 and coring sleeve 18 from concrete slurry infiltration during pouring and finishing of the floor slab 10. As with the cover 320 and coring plug 20, a portion of the top surface of the film may be textured to accept ink or pencil markings.

The coring plug 20 generally functions as an inexpensive substitute for a drain head or clean out to occupy or cover the space defined by the bowl cavity 53 during the concrete pouring and finishing steps. The plug thereby keeps concrete out of the bowl cavity 53. The diameter of the plug head 75 closely approximates the diameter of the fixture to be inserted in the bowl cavity 53. The plug head 75 is preferably as thick as the depth of the bowl cavity 53 such that a lower edge of the plug head 75 engages the upper surface of the flange 61 of the coring sleeve 18 to provide structural, generally load bearing support so that the plug does not break when heavy loads are moved across the upper surface of the plug 20 after the slab 10 has set.

As shown in the drawings, the threads for connecting the plug 20 to the coring sleeve 18 and the coring sleeve 18 to adaptor 16, such as threads 47, 55, 57 and 74 as well as the threads 35 on the stem 34 of the drain 5 adapted for use with the rough-in assembly 1 are preferably a square cut type thread. The square cut threads facilitate the draining of water down through the assembly and into the bore of drain pipe 7. The square threads also tend to facilitate relatively easy threading of one component relative to the other and are relatively durable.

It is to be understood that while certain forms of this invention have been illustrated and described, it is not limited thereto except insofar as such limitations are included in the following claims and allowable equivalents thereof. It is also to be understood that in any method claims set forth herein, unless specified otherwise in the claims, the steps of the method do not necessarily have to occur in the order set forth.

What is claimed is:

1. A system for mounting a utility access fixture in fluid communication with a conduit, the conduit presenting a free end below the intended surface level of a poured slab, the mounting system comprising:

a) a utility access fixture having a fixture head projecting radially outward from a central fixture mounting stem, b) a coring sleeve having a lower portion connectable in fluid communication with said conduit and a bowl projecting outward from said lower portion, said bowl defining a bowl cavity surrounding and opening centrally into a bore extending through said lower portion of said coring sleeve; said coring sleeve sized to removably receive the utility access fixture therein with the fixture head received within said bowl cavity and the central fixture mounting stem extending into said bore extending through said lower portion of said coring sleeve, and c) a cover removably positionable to extend across said bowl cavity above a top surface of the utility access fixture received within the coring sleeve such that an upper surface of said cover extends generally flush with an upper edge of said bowl.

2. The system as in claim 1 wherein said cover is plastic.

3. The system as in claim 1 wherein the utility access fixture includes a strainer which is fastened to the fixture head by at least one threaded fastener and wherein the cover includes at least one fastener opening positionable in alignment with the at least one threaded fastener such that the at least one threaded fastener can be used to secure the cover and the strainer to the utility access fixture.

4. The system as in claim 3 and further including an adhesive sticker for covering the at least one threaded fastener.

5. The system as in claim 3 wherein said utility access fixture further comprises a substantially ring-shaped shim that tapers in height from a relatively thick side to a relatively thin opposing side which is positionable above said fixture head and below said strainer to tilt said strainer relative to said fixture head.

6. The system as in claim 5 further comprising an adaptor connectable to an upper end of said drain pipe and wherein said coring sleeve is threadably securable to said adaptor.

7. The system as in claim 1 further comprising an adaptor connectable to an upper end of said drain pipe and wherein said coring sleeve is threadably securable to said adaptor.

8. The system of claim 1 wherein the fixture head received within said bowl cavity is downwardly and upwardly adjustable relative to said coring sleeve.

9. The system of claim 1 wherein said bowl further comprises an annular flange projecting outward from an upper open end of said lower portion of said coring sleeve, and an annular wall projecting upward from an outer portion of said annular flange, said annular wall spaced outward from said lower portion of said coring sleeve by said annular flange.

10. A drain fixture installation system for facilitating connection of a drain fixture to a drain pipe, the drain pipe presenting a free end below the intended surface level of a concrete slab, said system comprising:

a) a drain fixture including a fixture head at an upper end thereof and a lower, exteriorly threaded fixture stem with a bore extending therethrough, the fixture head projecting radially outward from the fixture stem;

b) a fixture receiver comprising:

i) a pipe connection adaptor having an adaptor bore extending centrally therethrough and sized for securement to the free end of the drain pipe such that said central adaptor bore extends in communication with the drain pipe; and ii) a coring sleeve comprising a fixture head receiving bowl including an annular flange projecting outward from an upper open end of a coring sleeve stem and an annular wall projecting upward from an outer portion of said annular flange, said annular wall spaced outward from said coring sleeve stem by said annular flange, said coring sleeve having a central coring sleeve bore extending therethrough and wherein said fixture head receiving bowl opens centrally into said coring sleeve bore; said coring sleeve stem is threadingly coupled to said pipe connection adaptor such that a level of an upper edge of said fixture head receiving bowl may be adjusted by rotating said coring sleeve relative to said pipe connection adaptor; said coring sleeve having an internal coring sleeve thread formed along said coring sleeve bore and below said fixture head receiving bowl; said fixture head receiving bowl sized to receive the fixture head therein with the lower, exteriorly threaded fixture stem extending into said coring sleeve bore and threadingly coupled to said internal coring sleeve thread;

c) a cover sized to cover a top surface of said fixture head and extend substantially across said fixture head receiving bowl when said fixture stem is connected to said internal, coring sleeve thread formed in said coring sleeve bore; said cover removably positionable above said fixture head such that an upper surface of said cover extends generally flush with an upper edge of said bowl; and wherein:

d) when said fixture receiver is connected to the drain pipe and said fixture stem is connected to said coring sleeve, concrete may be poured around the drain pipe and finished to a level generally flush with an uppermost extremity of said drain fixture installation system and said cover acts in combination with said fixture head receiving bowl to produce a void in the concrete in which a height of the fixture head relative to the level of the finished concrete can be adjusted once the concrete has hardened.

11. The drain fixture installation system as in claim 10 wherein said cover is formed from plastic.

12. The system as in claim 10 wherein the utility access fixture includes a strainer which is fastened to the fixture head by at least one threaded fastener and wherein the cover includes at least one fastener opening positionable in alignment with the at least one threaded fastener such that the at least one threaded fastener can be used to secure the cover and the strainer to the utility access fixture.

13. The system as in claim 12 and further including an adhesive sticker for covering the at least one threaded fastener.

14. A method of installing a utility access fixture on a conduit in a slab of poured material, the utility access fixture having an externally threaded cylindrical stem and a head projecting radially outward from an upper end of the stem, the method comprising the steps of:

a) connecting a coring sleeve to the conduit, the coring sleeve having a bowl formed at an upper end thereof and projecting radially outward from a lower, internally threaded coring sleeve stem, the bowl defining a bowl cavity;

b) installing a utility access fixture in the coring sleeve by threading the externally threaded stem of the utility access fixture into the internally threaded coring sleeve stem such that the head of the utility access fixture is received within the bowl cavity of the coring sleeve;

c) securing a cover over the utility access fixture, the cover sized such that an upper surface of the cover extends generally flush with an upper edge of the bowl and covers the bowl cavity;

d) pouring the poured material around said conduit;

e) finishing the poured material to a level generally flush with said upper surface of the cover to form the slab, the bowl and the cover acting in combination to form a void in the poured material;

f) allowing the poured material to harden;

g) removing the cover to provide access to the utility access fixture; and h) adjusting the height of the utility access fixture relative to the coring sleeve until an upper surface of the utility access fixture extends generally flush with a finished surface.

15. The method as in claim 14 wherein said securing step further comprises securing the cover to the utility access fixture.

16. The method as in claim 14 wherein said securing step further comprises securing the cover to the utility access fixture with one or more fasteners.

17. The method as in claim 14 wherein the utility access fixture includes a strainer fastened to the head of the utility access fixture by one or more fasteners and the same one or more fasteners are used to secure the cover to the utility access fixture.

18. The method as in claim 17 and further including a step of applying adhesive stickers over heads of the one or more fasteners after said securing step.

19. The method as in claim 17 further comprising the step of placing above said fixture head and below said strainer a leveling shim that tapers in height from a relatively thick side to a relatively thin opposing side in order to tilt said strainer relative to said fixture head.

20. The method as in claim 14 wherein the step of connecting a coring sleeve to a conduit comprises the step of threadingly coupling a lower end of the coring sleeve to the upper end of an adaptor and coupling a lower end of the adaptor to the upper end of the conduit such that the coring sleeve and adaptor extend in communication with the conduit and the height of the upper edge of the coring sleeve bowl is adjustable prior to pouring of the poured material by threadingly rotating the coring sleeve relative to the adaptor.

21. A utility access fixture installation system for mounting a utility access fixture in fluid communication with a conduit comprising:

a) a utility access fixture having a fixture head projecting radially outward from a central fixture mounting stem, the conduit presenting a free end below the intended surface level of a poured slab, b) a coring sleeve having a lower portion connectable in fluid communication with said conduit and a bowl including an annular flange projecting outward from said lower portion and an annular wall projecting upward from an outer portion of said annular flange, said annular wall spaced outward from said coring sleeve stem by said annular flange, said bowl defining a bowl cavity surrounding and opening centrally into a bore extending through said lower portion of said coring sleeve; said coring sleeve sized to removably receive the utility access fixture therein with the fixture head received within said bowl cavity and the central fixture mounting stem extending into said bore extending through said lower portion of said coring sleeve, and c) a plug removably positionable in said bowl cavity, prior to reception of the utility access fixture within said coring sleeve, said plug sized to extend across and cover said bowl cavity and such that an upper surface of said plug extends generally flush with an upper edge of said bowl; and d) wherein said fixture head of said utility access fixture is sized to extend across and cover said bowl cavity and is axially adjustable relative to said coring sleeve when said central fixture mounting stem is received in said coring sleeve upon removal of said plug.

22. The system as in claim 21 wherein said plug includes a threaded stem and an enlarged head projecting outward from said threaded stem; wherein said threaded stem may be threadingly coupled to an internal thread in said lower portion of said coring sleeve.

23. The system of claim 21 wherein the fixture head received within said bowl cavity is downwardly and upwardly adjustable relative to said coring sleeve.

24. The system as in claim 21 further comprising an adaptor connectable to an upper end of said drain pipe and wherein said coring sleeve is threadably securable to said adaptor.

25. A drain fixture installation system for facilitating connection of a drain fixture to a drain pipe, the drain pipe presenting a free end below the intended surface level of a poured slab, said system comprising:

a) a drain fixture including a fixture head and an externally threaded fixture stem with a fixture bore extending therethrough, the fixture head projecting radially outward from the fixture stem;

b) a coring sleeve having a coring sleeve stem connectable in fluid communication with the drain pipe and a bowl comprising an annular flange projecting outward from an upper open end of said coring sleeve stem and an annular wall projecting upward from an outer portion of said annular flange, said annular wall spaced outward from said coring sleeve stem by said annular flange, said bowl defining a bowl cavity surrounding and opening into a coring sleeve bore extending through said coring sleeve stem; said coring sleeve stem having an internal thread formed therein below said bowl cavity; said bowl cavity sized to receive the fixture head therein with the fixture stem threadingly coupled to and within said coring sleeve stem such that said fixture head may be positioned within said bowl cavity with an upper surface of said fixture head extending generally flush with an upper edge of said bowl; and c) a plug removably positionable in said bowl cavity prior to reception of the fixture head therein, said plug sized to extend across and cover said bowl cavity with an upper surface of said plug extending generally flush with an upper edge of said bowl; and d) wherein said fixture head of said drain fixture is sized to extend across and cover said bowl cavity and is axially adjustable relative to said coring sleeve when said central fixture mounting stem is received in said coring sleeve upon removal of said plug.

26. The system as in claim 25 wherein said plug includes a threaded stem and an enlarged head projecting outward from said threaded stem; wherein said threaded stem may be threadingly coupled to an internal thread in said coring sleeve stem.

27. The system as in claim 25 wherein said drain fixture head comprises a strainer connected to a drain fixture flange projecting radially outward from said externally threaded fixture stem.

28. The system as in claim 27 wherein said bowl cavity is deeper than said drain fixture head.

29. A drain fixture installation system for facilitating connection of a drain fixture to a drain pipe, the drain pipe presenting a free end below the intended surface level of a poured slab, said system comprising:

a) a drain fixture including a fixture head and an externally threaded fixture stem with a fixture bore extending therethrough, the fixture head projecting radially outward from the fixture stem;

b) a coring sleeve having a coring sleeve stem connectable in fluid communication with the drain pipe and a bowl projecting outward from an upper open end of said coring sleeve stem, said bowl having an upwardly projecting annular outer wall spaced outward from said coring sleeve stem, said bowl defining a bowl cavity surrounding and opening into a coring sleeve bore extending through said coring sleeve stem; said coring sleeve stem having an internal thread formed therein below said bowl cavity; said bowl cavity sized to receive the fixture head therein with the fixture stem threadingly coupled to and within said coring sleeve stem such that said fixture head may be positioned within said bowl cavity with an upper surface of said fixture head extending generally flush with an upper edge of said bowl; and c) a plug removably positionable in said bowl cavity prior to reception of the fixture head therein, said plug sized to extend across and cover said bowl cavity with an upper surface of said plug extending generally flush with an upper edge of said bowl; and d) wherein said fixture head of said drain fixture is sized to extend across and cover said bowl cavity and is axially adjustable relative to said coring sleeve when said central fixture mounting stem is received in said coring sleeve upon removal of said plug.

* * * * *